US008606161B2

(12) United States Patent
Nanjo et al.

(10) Patent No.: US 8,606,161 B2
(45) Date of Patent: Dec. 10, 2013

(54) IMAGE FORMING APPARATUS WITH INDUCTION HEATING TYPE FIXING UNIT

(71) Applicant: KYOCERA Document Solutions, Inc., Osaka (JP)

(72) Inventors: Yuzuru Nanjo, Osaka (JP); Tamami Asari, Osaka (JP)

(73) Assignee: Kyocera Document Solutions Inc. (JP)

( * ) Notice: Subject to any disclaimer, the term of this patent is extended or adjusted under 35 U.S.C. 154(b) by 0 days.

(21) Appl. No.: 13/896,687

(22) Filed: May 17, 2013

(65) Prior Publication Data

US 2013/0251423 A1 Sep. 26, 2013

Related U.S. Application Data

(62) Division of application No. 12/512,423, filed on Jul. 30, 2009, now Pat. No. 8,457,539.

(30) Foreign Application Priority Data

Jul. 30, 2008 (JP) ..... 2008-196801

(51) Int. Cl.
*G03G 15/20* (2006.01)

(52) U.S. Cl.
USPC ..... 399/328; 399/329; 219/619

(58) Field of Classification Search
USPC ..... 399/328; 219/619
See application file for complete search history.

(56) References Cited

U.S. PATENT DOCUMENTS

RE36,962 E 11/2000 Higashi et al.
6,849,838 B2 2/2005 Shimizu et al.
7,266,336 B2 9/2007 Ueno et al.
7,715,774 B2 5/2010 Ueno
7,783,240 B2 * 8/2010 Ito et al. ..... 399/328

(Continued)

FOREIGN PATENT DOCUMENTS

CN 1573607 6/2004
JP 06-318001 11/1994

(Continued)

OTHER PUBLICATIONS

Jul. 30, 2009 IDS for U.S. Appl. No. 12/512,423.

(Continued)

*Primary Examiner* — David Gray
*Assistant Examiner* — Geoffrey Evans
(74) *Attorney, Agent, or Firm* — Gerald E. Hespos; Michael J. Porco; Matthew T. Hespos

(57) ABSTRACT

A fixing unit of an image forming apparatus includes a coil arranged along an outer surface of the heating member and generating a magnetic field, a first core arranged opposite the heating member with respect to the coil and forming a magnetic path, a second core so fixed between the first core and the heating member with respect to a direction in which the coil generates the magnetic field, as to form the magnetic path together with the first core, a shielding member positioned outward of the second core and shielding the magnetism in the magnetic path, and a magnetism adjusting unit moving the shielding member outward of the second core to switch the position of the shielding member between a shielding position where the shielding member shields the pass of the magnetism and a retracted position where the shielding member permits the pass of the magnetism.

11 Claims, 21 Drawing Sheets

(56) References Cited

U.S. PATENT DOCUMENTS

| | | | | |
|---|---|---|---|---|
| 7,835,680 | B2 | 11/2010 | Nanjo et al. | |
| 7,890,042 | B2 | 2/2011 | Ishida et al. | |
| 7,925,177 | B2 | 4/2011 | Ishii et al. | |
| 7,949,290 | B2 | 5/2011 | Yoshikawa | |
| 7,995,958 | B2 | 8/2011 | Gon et al. | |
| 8,078,072 | B2 | 12/2011 | Nanjo et al. | |
| 8,175,509 | B2 | 5/2012 | Gon | |
| 8,229,339 | B2 | 7/2012 | Nanjo | |
| 8,233,832 | B2 | 7/2012 | Gon | |
| 8,355,660 | B2 * | 1/2013 | Nanjo | 399/329 |
| 8,457,539 | B2 * | 6/2013 | Nanjo et al. | 399/328 |
| 2002/0190060 | A1 | 12/2002 | Imai et al. | |
| 2004/0253027 | A1 | 12/2004 | Kato et al. | |
| 2005/0088796 | A1 * | 4/2005 | Fujimoto | 361/143 |
| 2005/0191098 | A1 | 9/2005 | Ueno et al. | |
| 2007/0014599 | A1 | 1/2007 | Yasuda et al. | |
| 2007/0014601 | A1 | 1/2007 | Yasuda et al. | |
| 2007/0201916 | A1 | 8/2007 | Ueno | |
| 2007/0264060 | A1 | 11/2007 | Ueno et al. | |
| 2007/0274748 | A1 | 11/2007 | Yoshikawa | |
| 2009/0175644 | A1 | 7/2009 | Nanjo et al. | |
| 2009/0175664 | A1 | 7/2009 | Nanjo et al. | |
| 2009/0214243 | A1 | 8/2009 | Yoda et al. | |
| 2009/0245898 | A1 | 10/2009 | Gon et al. | |
| 2009/0245902 | A1 | 10/2009 | Gon et al. | |
| 2009/0269109 | A1 | 10/2009 | Ishida et al. | |
| 2010/0014900 | A1 | 1/2010 | Gon | |
| 2010/0046996 | A1 | 2/2010 | Nanjo et al. | |
| 2010/0067929 | A1 | 3/2010 | Seki | |
| 2010/0104334 | A1 | 4/2010 | Nanjo | |
| 2010/0272482 | A1 | 10/2010 | Nanjo | |
| 2010/0272483 | A1 | 10/2010 | Nanjo | |
| 2011/0052281 | A1 | 3/2011 | Gon | |
| 2011/0182637 | A1 | 7/2011 | Okada | |
| 2011/0217097 | A1 | 9/2011 | Nanjo | |
| 2011/0236091 | A1 | 9/2011 | Tanda | |
| 2011/0318075 | A1 | 12/2011 | Tanda | |
| 2011/0318076 | A1 | 12/2011 | Tanda | |
| 2012/0020710 | A1 | 1/2012 | Motoki | |
| 2012/0057909 | A1 | 3/2012 | Gon | |
| 2012/0099909 | A1 | 4/2012 | Nanjo | |
| 2012/0201583 | A1 | 8/2012 | Takeuchi | |
| 2012/0207502 | A1 | 8/2012 | Seo | |
| 2012/0328339 | A1 | 12/2012 | Moriguchi | |

FOREIGN PATENT DOCUMENTS

| | | |
|---|---|---|
| JP | 2003-107941 | 4/2003 |
| JP | 3527442 | 2/2004 |
| JP | 2006195408 | 7/2006 |

OTHER PUBLICATIONS

Apr. 8, 2011 IDS for U.S. Appl. No. 12/512,423.
Jun. 11, 2012 Office Action for U.S. Appl. No. 12/512,423.
Oct. 18, 2012 IDS for U.S. Appl. No. 12/512,423.
Nov. 16, 2012 Office Action for U.S. Appl. No. 12/512,423.

* cited by examiner

MAGNETIC SHIELDING FOR MEDIUM/SMALL SIZE (120°)

ZERO MAGNETIC SHIELDING (180°)

MAGNETIC SHIELDING FOR MEDIUM SIZE (240°)

IMAGE FORMING APPARATUS WITH INDUCTION HEATING TYPE FIXING UNIT

This application is a divisional of U.S. patent application Ser. No. 12/512,423 filed on Jul. 30, 2009.

BACKGROUND OF THE INVENTION

1. Field of the Invention

The present invention relates to an image forming apparatus including a fixing unit which is configured to fix a toner image to a sheet by fusing the unfixed toner while the sheet is passed through a nip between a pair of heated rollers or between a heating belt and a roller.

2. Description of the Related Art

In the aforementioned kind of image forming apparatus, fixing belt systems attract attention due to growing demand for a reduction in warm-up time of a fixing unit and energy savings in recent years. This is because a fixing belt has a low heat capacity as mentioned in Japanese Unexamined Patent Publication No. 6-318001, for example. Also attracting attention recently is electromagnetic induction heating (IH) technology which offers a high-speed, high-efficiency heating capability. Today, products developed by using a combination of the IH technology and belt systems for achieving energy savings in a process of fusing color toner images are available in large quantities on the market. An arrangement widely used combining the IH technology and belt systems is to dispose an induction heating element on the outside of the heating belt (known as an external IH system). The external IH system is often used because this arrangement provides such advantages as ease of layout and cooling of an induction coil and a capability to directly heat the heating belt.

In practical applications of the IH technology, there exist various arrangements devised for preventing overheating of non-sheet passing areas of a fixing roller of a fixing unit according to the width (sheet passing width) of each sheet of paper passed through the fixing unit. For example, Japanese Unexamined Patent Publication No. 2003-107941 and Japanese Patent No. 3527442 introduce means for altering a heated area of a fixing roller according to the sheet passing width. These means of the prior art (hereinafter referred to as first and second prior art arrangements) intended particularly for external induction heating are configured as briefly described hereunder.

The first prior art arrangement shown in Japanese Unexamined Patent Publication No. 2003-107941 applied to a fixing unit includes a magnetic member, an exciting coil and a moving mechanism. The magnetic member is divided into a plurality of pieces which are arranged along a sheet passing width direction, and the moving mechanism moves part of the magnetic member toward and away from the exciting coil according to the width of each sheet passed through the fixing unit. It is supposed that an effect of this arrangement is to decrease heating efficiency in a non-sheet passing area by separating the magnetic member from the exciting coil, thus reducing the amount of heat generated in the non-sheet passing area than in an area corresponding to a minimum sheet passing width.

The second prior art arrangement shown in Japanese Patent No. 3527442 applied to a fixing unit is such that an additional electrically conductive member is disposed within a heating roller in an area outside a minimum sheet passing width, wherein this electrically conductive member is made movable between a position within a range of a magnetic field and a position outside the range of the magnetic field. In this prior art arrangement, the heating roller is preheated by induction heating with the electrically conductive member initially arranged outside the range of the magnetic field. When the heating roller is heated almost up to the Curie temperature, the electrically conductive member is moved to the outside of the range of the magnetic field, causing magnetic flux to leak from the heating roller outside the minimum sheet passing width to prevent overheating.

In the first prior art arrangement, the magnetic member should have a large movable range, so that this arrangement has a problem that the entirety of the fixing unit becomes unnecessarily large. On the other hand, the second prior art arrangement offers a space-saving capability because means for altering a heated area is provided in an internal space of the heating roller. The internal space of the heating roller is however a high-temperature environment. Therefore, if some kind of component is mounted inside the heating roller, it is necessary to increase the Curie temperature of the heating roller and, in addition, there arises a problem that the provision of a large-sized component having a large heat capacity within the heating roller causes an increase in warm-up time thereof.

SUMMARY OF THE INVENTION

Accordingly, it is an object of the invention to provide a technique which makes it possible to reduce the number of components mounted within a heating element of a fixing unit of an image forming apparatus, thereby lowering total heat capacity and achieving a reduction in warm-up time of the fixing unit and space savings.

To accomplish the aforementioned object of the invention, an image forming apparatus includes an image forming section for forming a toner image and transferring the toner image onto a sheet, and a fixing unit including a heating member and a pressing member, and fixing the toner image onto the sheet while nipping and conveying the sheet between the heating member and the pressing member. The fixing unit further includes a coil arranged along an outer surface of the heating member and generating a magnetic field, a first core arranged opposite the heating member with respect to the coil and forming a magnetic path, a second core so fixed between the first core and the heating member with respect to a direction in which the coil generates the magnetic field, as to form the magnetic path together with the first core, a shielding member positioned outward of the second core and shielding the magnetism in the magnetic path, and a magnetism adjusting unit moving the shielding member outward of the second core to switch the position of the shielding member between a shielding position where the shielding member shields the pass of the magnetism and a retracted position where the shielding member permits the pass of the magnetism.

These and other objects, features and advantages of the invention will become more apparent upon a reading of the following detailed description in conjunction with the accompanying drawings.

DETAILED DESCRIPTION OF THE PREFERRED EMBODIMENTS

Now, a preferred embodiment of the invention is described in detail with reference to the accompanying drawings.

Figure 1:
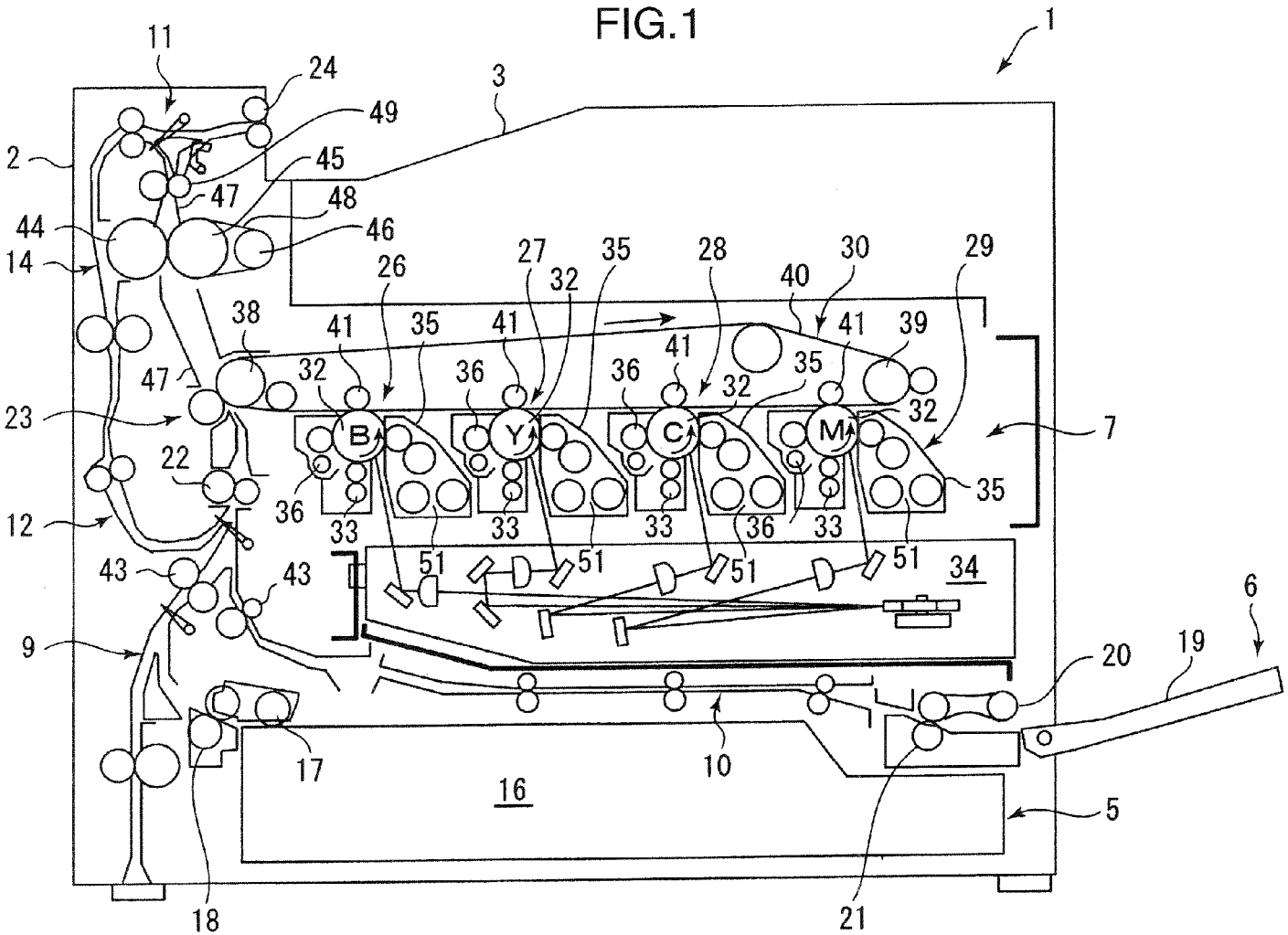
FIG. 1 is a cross-sectional diagram schematically showing the structure of an image forming apparatus according to a preferred embodiment of the invention.

FIG. 1 is a schematic cross-sectional diagram showing the structure of an image forming apparatus 1 according to the preferred embodiment of the invention. The image forming apparatus 1 may be a printer, a copying machine, a facsimile machine or a hybrid apparatus thereof which are configured to perform printing operation by forming a toner image based on externally input image information, for instance, and transferring the toner image to a surface of a printing medium like a sheet of paper.

The image forming apparatus 1 shown in FIG. 1 is a tandem-type color printer, for example. The image forming apparatus 1 includes a generally boxlike apparatus body 2 incorporating a print engine for forming (printing) a color image on a sheet and a sheet output portion (output tray) 3 arranged at the top of the apparatus body 2 where the sheet carrying the printed color image is output.

Referring to FIG. 1, provided at a lower part of the apparatus body 2 is a paper cassette 5 for holding a stack of sheets and provided on one side of the apparatus body 2 is a manual feed tray 6 on which a plurality of sheets can be placed for manually feeding one sheet after another. Incorporated in an upper part of an internal space of the apparatus body 2 is an image forming section 7 which forms an image on the sheet based on image data containing text and graphics data fed from an external source, for instance.

As illustrated in FIG. 1, there is provided a first paper path 9 on a left side of the apparatus body 2 for feeding each successive sheet supplied from the paper cassette 5 to the image forming section 7. Also, there is provided a second paper path 10 extending from a right side of the apparatus body 2 to the left side thereof for manually feeding the sheet from the manual feed tray 6 to the image forming section 7. Provided in an upper left part (as illustrated) of the internal space of the apparatus body 2 are a fixing unit 14 for performing fixing operation on the sheet carrying the image formed in the image forming section 7 and a third paper path 11 through which the sheet carrying the fixed image is conveyed to the sheet output portion 3.

A user can replenish the stack of sheets in the paper cassette 5 by pulling the paper cassette 5 out of the apparatus body 2 (frontward as shown in FIG. 1). The paper cassette 5 has a boxlike compartment 16 for selectively storing at least two kinds of sheets having different sizes in a sheet passing direction. An uppermost one of the sheets stored in the paper cassette 5 is picked up and fed into the first paper path 9 one after another by a pickup roller 17 and a double feed preventing roller 18.

The manual feed tray 6 is made swingable outward from a side surface of the apparatus body 2 and back to a vertical position. The manual feed tray 6 has a tray top 19 on which the user can place one or a plurality of sheets at a time for manual feeding one sheet after another. Each sheet placed on the tray top 19 is successively picked up and fed into the second paper path 10 by a pickup roller 20 and a double feed preventing roller 21.

The first paper path 9 and the second paper path 10 join into a single path slightly upstream of a pair of registration rollers 22. The sheet which has reached a position immediately upstream of the registration rollers 22 is kept standby for a while where adjustments for removing a skew (oblique feed) of the sheet and taking precise feed timing thereof are made. After these adjustments, the registration rollers 22 feed the sheet to a secondary image transfer portion 23 for transferring a full-color toner image formed on an intermediate image transfer belt 40 to the sheet. The sheet is then advanced to the fixing unit 14 to fix the toner image to the sheet. In the case of two-sided printing (or duplexing), the sheet carrying the full-color toner image fixed in the fixing unit 14 on one side is reversed in a switchback fashion and returned to the position upstream of the registration rollers 22 through a fourth paper path 12 for transferring a full-color toner image on the opposite side of the sheet. After the toner image on the opposite side of the sheet is fixed thereto in the fixing unit 14, the sheet is conveyed through the third paper path 11 and ejected to the sheet output portion 3 by means of a pair of output rollers 24.

The image forming section 7 includes four image forming units 26-29 for forming black (B), yellow (Y), cyan (C) and magenta (M) toner images, respectively, and an intermediate image transfer mechanism 30 for carrying the toner images in four colors (including black) formed by the individual image forming units 26-29, wherein the four color toner images are superimposed one on top of another.

As shown in FIG. 1, the four image forming units 26-29 each include a photosensitive drum 32, a charging unit 33 disposed face to face with a curved outer surface of the photosensitive drum 32, a development unit 35 disposed face to face with the curved outer surface of the photosensitive drum 32, a cleaning unit 36 disposed downstream of the development unit 35 face to face with the curved outer surface of the photosensitive drum 32. Additionally, the four image forming units 26-29 is provided with a laser scanner 34 disposed downstream of each charging unit 33 for projecting a laser beam along specified positions on the curved outer surface of each photosensitive drum 32. The development unit 35 of each of the image forming units 26-29 is arranged at a position downstream of the aforementioned positions scanned by the laser beam emitted from the laser scanner 34.

Although not shown in FIG. 1, the photosensitive drums 32 of the four image forming units 26-29 are driven by individual driving motors to rotate in a counterclockwise direction as illustrated. The development units 35 of the image forming units 26-29 include toner boxes 51 containing black, yellow, cyan and magenta toners, respectively.

Referring to FIG. 1, the intermediate image transfer mechanism 30 includes a driving roller 38 arranged close to the black image forming unit 26, a driven roller 39 arranged close to the magenta image forming unit 29, the aforementioned intermediate image transfer belt 40 mounted between the driving roller 38 and the driven roller 39, and four image transfer rollers 41 arranged at positions downstream of the development units 35 with respect to the counterclockwise turning direction of the respective image forming units 26-29 such that the image transfer rollers 41 can be pressed against the respective photosensitive drums 32 via the intermediate image transfer belt 40.

The working of the intermediate image transfer mechanism 30 is such that the four color toner images (including the black toner image) are transferred to the intermediate image transfer belt 40 one on top of another at locations of the image transfer rollers 41 of the respective image forming units 26-29 to form a full-color toner image.

The first paper path 9 serves to convey the sheet supplied from the paper cassette 5 toward the intermediate image transfer mechanism 30. The first paper path 9 is associated with a plurality of convey rollers 43 arranged at specific positions within the apparatus body 2 and the aforementioned registration rollers 22 which are provided upstream of the intermediate image transfer mechanism 30 for establishing correct timings of image forming and sheet convey operations performed by the image forming section 7.

The fixing unit 14 performs the fixing operation to fix an unfixed toner image to the sheet by applying heat and pressure to the sheet carrying the toner image transferred thereto in the image forming section 7. The fixing unit 14 is provided with a heatable roller pair including a pressing roller 44 and a fixing roller 45, for example. The pressing roller 44 has a metallic core member and a surface layer made of elastic material (e.g., silicone rubber) whereas the fixing roller 45 has a metallic core member, a surface layer made of elastic material (e.g., silicone sponge) and a releasing layer made of perfluoroalkoxy (PFA), for instance. The fixing unit 14 is also provided with a heat roller 46 arranged adjacent to the fixing roller 45 as well as a heating belt 48 mounted between the fixing roller 45 and the heat roller 46. The structure of the fixing unit 14 will be described later in greater detail.

There are provided upstream and downstream paper paths 47 on upstream and downstream sides of the fixing unit 14 with respect to a sheet feeding direction. The sheet conveyed through the intermediate image transfer mechanism 30 is introduced into a nip between the pressing roller 44 and the fixing roller 45 through the upstream paper path 47. Then, the sheet which has passed between the pressing roller 44 and the fixing roller 45 is guided to the third paper path 11 through the downstream paper path 47.

The third paper path 11 conveys the sheet carrying the toner image fixed thereto in the fixing unit 14 to the sheet output portion 3. The third paper path 11 is provided with convey rollers 49 arranged at appropriate positions as well as the aforementioned output rollers 24 arranged at an output end of the third paper path 11.

<Detailed Structure of Fixing Unit>

Now, the structure of the fixing unit 14 of the image forming apparatus 1 of the present embodiment is described in detail.

Figure 2:
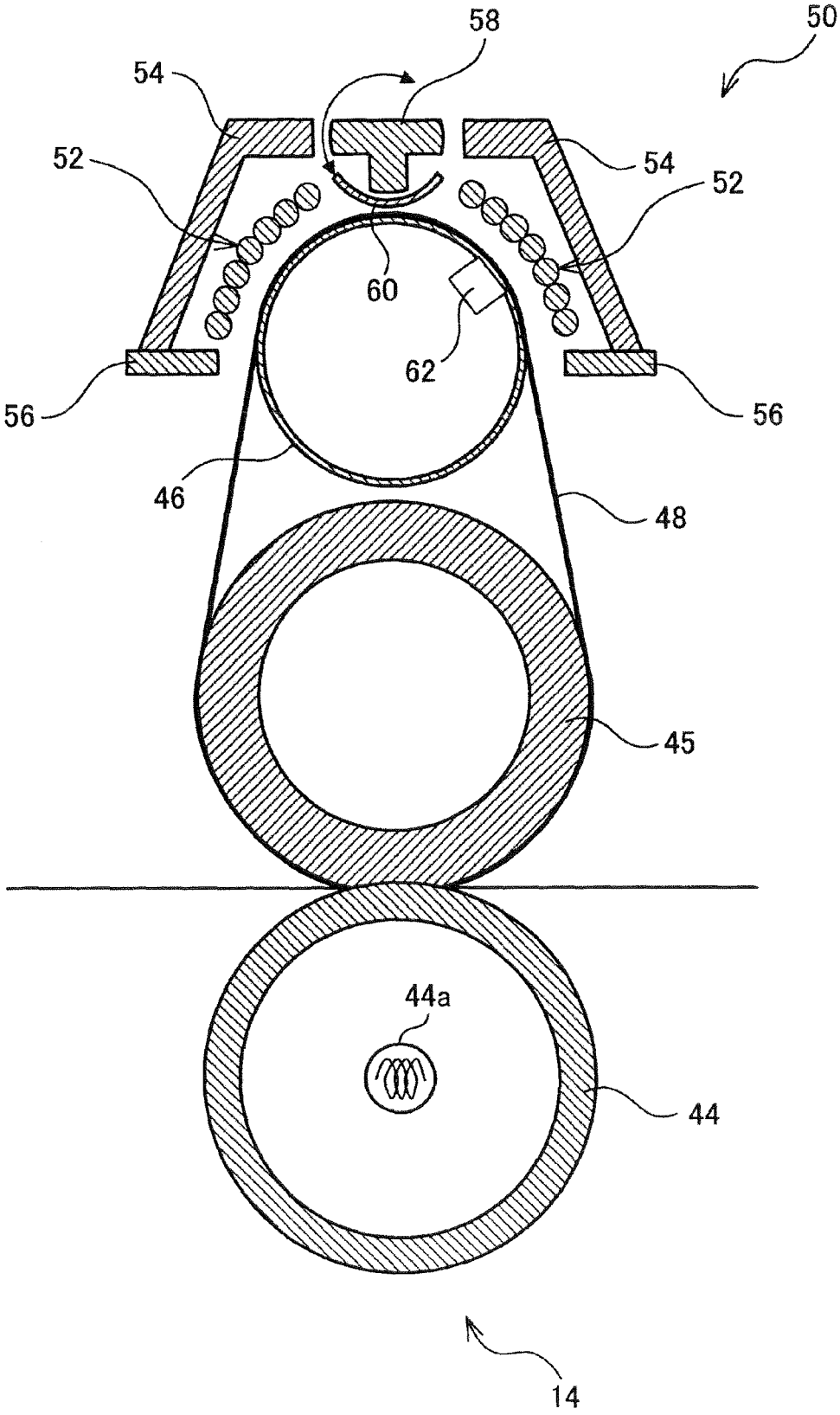
FIG. 2 is a vertical cross-sectional diagram showing an example of the structure of a fixing unit.

FIG. 2 is a vertical cross-sectional diagram showing an example of the structure of the fixing unit 14, in which the fixing unit 14 is shown in a position rotated counterclockwise by about 90 degrees from a position actually mounted in the image forming apparatus 1. Therefore, the sheet feeding direction going upward from the lower part of the apparatus body 2 as illustrated in FIG. 1 points from right to left in FIG. 2. It is to be noted that if the apparatus body 2 of the image forming apparatus 1 is large-sized (in the case of a hybrid machine, for example), there can be a case where the fixing unit 14 is installed in the position (direction) shown in FIG. 2.

The fixing unit 14 is provided with the pressing roller 44, the fixing roller 45, the heat roller 46 and the heating belt 48 as stated above. The sheet of paper having the toner image transferred thereon is nipped and conveyed between the pressing roller 44 and the heating belt 48. At this time, the sheet pf paper receives heat from the heating belt 48 and the toner image is fixed on the sheet of paper. The heating belt 48 has a sheet-conveyed region so set thereon that the sheet of paper of maximum size conveyable to the fixing unit 14 is brought into contact with the sheet-conveyed region. Since the fixing roller 45 has the surface layer made of the elastic material (e.g., silicone sponge) as mentioned above, there is formed a flat nip between the heating belt 48 and the fixing roller 45.

The heating belt 48 employs a ferromagnetic substance (e.g., nickel) as a base material and has a surface layer made of elastic material (e.g., silicone rubber) of which outside is covered with a coating of releasing agent (e.g., PFA). If the heating belt 48 is not required to have a heating function, the heating belt 48 may be a simple resin belt made of polyimide (PI), for instance. The heat roller 46 has a metallic core member made of magnetic metal (e.g., iron or stainless steel) of which outer surface is covered with a coating of releasing agent (e.g., PFA).

More specifically, the pressing roller 44 employs such material as iron or aluminum as the metallic core member and has a silicone rubber layer covering the metallic core member as well as a fluoroplastic layer formed on an outer surface of the silicone rubber layer. The pressing roller 44 may be configured to incorporate a halogen heater **44*a*** in an internal space as illustrated, for instance.

Additionally, the fixing unit 14 is provided with an IH coil unit 50 (not shown in FIG. 1) arranged outside the heat roller 46 and the heating belt 48. The IH coil unit 50 is configured with an induction heating coil 52, a pair of arch cores 54, a pair of side cores 56 and a center core 58.

<Coil>

The fixing unit 14 shown in the example of FIG. 2 is configured such that induction heating is performed on the heat roller 46 and arc-shaped portions of the heating belt 48 over the substantially entire region of the heating belt 48 in the width direction thereof. Therefore, the induction heating coil 52 is arranged on an outer surface segment of an imaginary cylinder. In actuality, there is provided a plastic bobbin (not shown) outside the heat roller 46 and the heating belt 48 and the induction heating coil 52 is wound on this unillustrated bobbin which is formed into a semicylindrical shape disposed along a curved outer surface of the heat roller 46. Preferably, the bobbin is made of a heat-resistant resin material, such as polyphenylene sulfide (PPS), polyethylene terephthalate (PET) or liquid crystal plastic (LCP).

<First Cores>

As shown in FIG. 2, the center core 58 is arranged at a middle position while the aforementioned arch cores 54 and side cores 56 are arranged in pairs on both sides of the center core 58. Among the arch cores 54 and the side cores 56, the arch cores 54 on both sides of the center core 58 are ferrite cores (first cores) formed into a symmetrical arch-like shape in cross section, each of the arch cores 54 having an overall length longer than a winding area of the induction heating coil 52. Also, the side cores 56 on both sides of the center core 58 are ferrite cores (first cores) formed into a block-like shape. The side cores 56 on both sides are connected to extreme ends (lower ends as shown in FIG. 2) of the respective arch cores 54, covering the outside of the winding area of the induction heating coil 52. The arch cores 54 are divided into plural core segments which are arranged at specific intervals along a longitudinal direction of the heat roller 46, for example. On the other hand, each of the side cores 56 is a single (undivided) core segment arranged straight along the longitudinal direction of the heat roller 46, the side cores 56 having an overall length corresponding to the length of the winding area of the induction heating coil 52.

The arrangement of these cores 54, 56 is determined in accordance with a distribution of magnetic flux density (magnetic field strength) produced by the induction heating coil 52, for instance. As the core segments of the arch cores 54 are arranged at specific intervals as mentioned above, the side cores 56 make up for an effect of magnetic focusing in regions where no core segments of the arch cores 54 are present, thereby equalizing the magnetic flux density distribution along the longitudinal direction of the heat roller 46. Outside the arch cores 54 and the side cores 56, there is provided an unillustrated plastic core holder, for example, which supports the arch cores 54 and the side cores 56. Preferably, the core holder is also made of a heat-resistant resin material, such as PPS, PET or LCP.

In the illustrated example of FIG. 2, the heat roller 46 incorporates a thermistor 62 which may be arranged at a position where a large amount of heat is generated especially by induction heating within the heat roller 46. Additionally, there may be provided a thermostat inside the heat roller 46 to achieve improved safety in the event of an abnormal temperature increase.

<Second Core>

The aforementioned center core 58 is a ferrite core (second core) having a generally T-shape in cross section, for instance. Generally like the heat roller 46, the center core 58 has a length corresponding to a maximum sheet passing width. The center core 58 is fixedly mounted between the arch cores 54 and the side cores 56 on both sides (or halfway in a magnetic path produced by the induction heating coil 52). Although not illustrated in FIG. 2, the center core 58 is supported by the aforementioned plastic core holder.

<Shielding Member>

A shielding member 60 is arranged outward of the center core 58 along an outer periphery of the center core 58. The shielding member 60 is constituted by a thin-plate formed by bending in an arcuate shape. The shielding member 60 is supported by an unillustrated rotation mechanism out of contact with the center core 58 in a manner that the shielding member 60 can be rotated along the outer periphery of the center core 58 by the rotation mechanism in an arrow direction shown in FIG. 2. How the shielding member 60 is supported and how the aforementioned rotation mechanism is structured will be discussed later in further detail.

Preferably, the shielding member 60 is made of a nonmagnetic, good conductor like oxygen-free copper, for example. As a magnetic field penetrates the shielding member 60 at right angles to a surface thereof, an induction current is induced in the shielding member 60. The induction current produces a magnetic field oriented in a direction opposite to the magnetic field applied to the shielding member 60, canceling out interlinkage of magnetic flux (i.e., the perpendicularly penetrating magnetic field) and thus shielding the applied magnetic field. Also, as the good conductor is used in the shielding member 60, it is possible to suppress generation of Joule heat by the induction current and efficiently shield the magnetic field. Electrical conductivity of the conductor used in the shielding member 60 can effectively be improved by (1) selecting a material having as low a resistivity as possible and/or (2) using a plate-like member having a large thickness, for instance. Specifically, the thickness of the shielding member 60 should preferably be equal to or larger than 0.5 mm. The shielding member 60 used in this embodiment is 1 mm thick.

If the shielding member 60 is at a position in the proximity of an outer surface of the heating belt 48 (i.e., at a shielding position) as shown in FIG. 2, magnetic reluctance increases in an area surrounding the induction heating coil 52, causing a reduction in magnetic field strength. If the shielding member 60 is rotated by 180 degrees either clockwise or counterclockwise from the position shown in FIG. 2 to a position farthest away from the heating belt 48 (i.e., at a retracted position), On the other hand, the magnetic reluctance decreases in the area surrounding the induction heating coil 52 and there is formed a magnetic path routed from the center core 58 through the arch cores 54 and the side cores 56 on both sides of the center core 58. Consequently, the magnetic field acts on the heating belt 48 and the heat roller 46.

<Exemplary Structure (1) of Shielding Member>

Figure 3A:
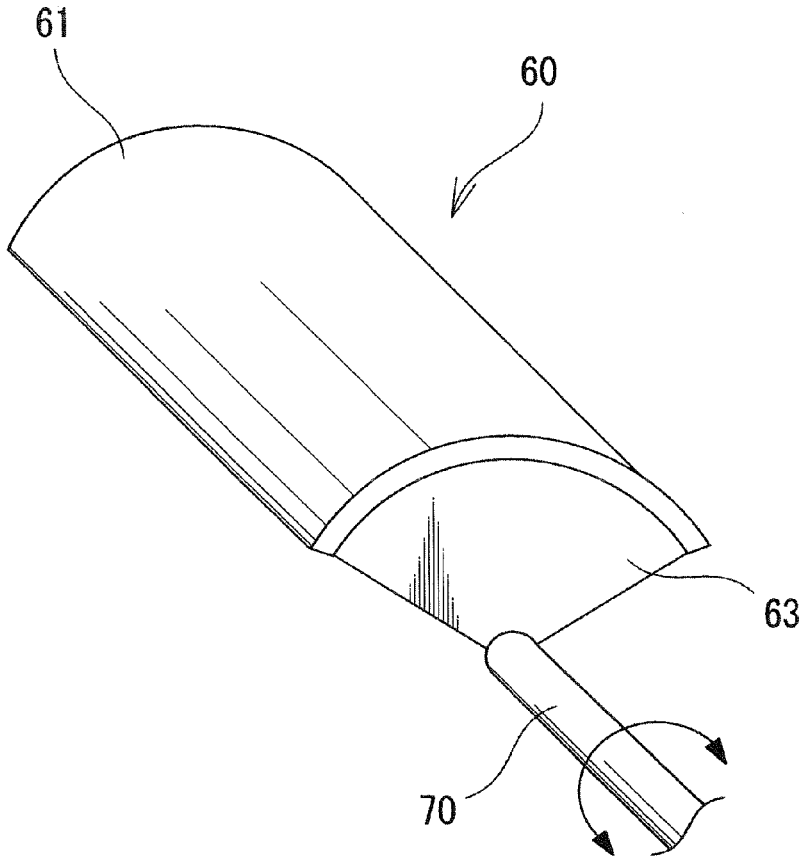
FIGS. 3A and 3B are perspective views showing exemplary structure (1) of a shielding member of the fixing unit of FIG. 2.
Figure 3B:
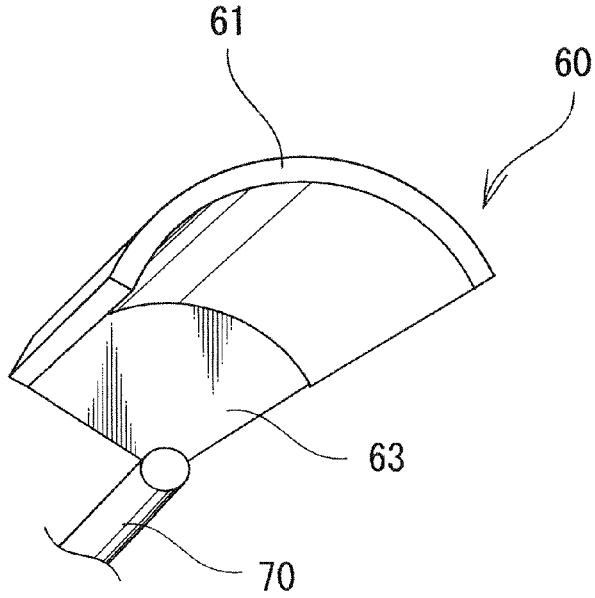

FIGS. 3A and 3B are perspective views showing exemplary structure (1) of a shielding member 60, FIG. 3A showing the shielding member 60 at the retracted position as seen obliquely downward and FIG. 3B showing the same as seen obliquely upward. The shielding member 60 is configured chiefly with a shielding plate 61 forming a curved surface and a fan-shaped side plate 63. The curvature of the shielding plate 61 is determined such that the shielding member 60 can be rotated around the outer periphery of the center core 58. The side plate 63 is affixed to the inside of the shielding plate 61 at one end thereof and connected to a driving shaft 70 arranged at an apex of the fan-shaped side plate 63. A central axis of the driving shaft 70 coincides with the center of curvature of the shielding plate 61. When the driving shaft 70 is rotated by motive power produced by an unillustrated motor, the shielding member 60 is caused to turn about the central axis together with the driving shaft 70. While the shielding member 60 of the embodiment shown in FIGS. 3A and 3B has a uniform width (in a portion of the shielding plate 61) along a longitudinal direction, this structure may be modified such that the width of the shielding member 60 varies along the longitudinal direction as will be discussed in the following.

Figures 4A, 4B:
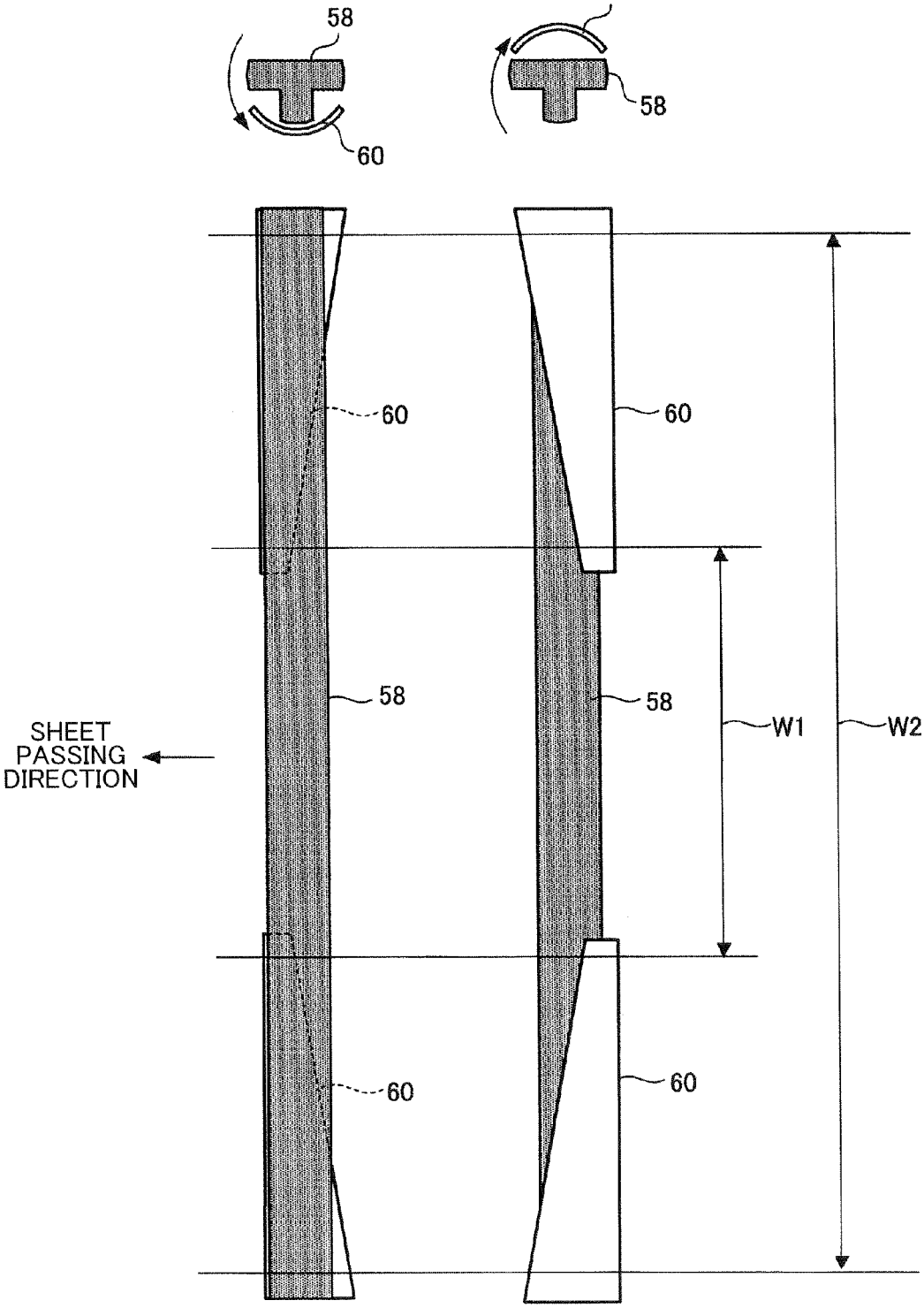
FIGS. 4A and 4B are diagrams showing a shielding member whose width is varied along a longitudinal direction as well as an example of an arrangement of this shielding member.

FIGS. 4A and 4B are diagrams showing a shielding member 60 whose width is varied along the longitudinal direction as well as an example of an arrangement of this shielding member 60, FIG. 4A showing the shielding member 60 arranged at the shielding position and FIG. 4B showing the shielding member 60 arranged at the retracted position. FIGS. 4A and 4B each show a side view and a plan view of the center core 58, respectively, in which outer surfaces of the center core 58 are shown by halftone dots.

The center core 58 has an overall length generally equal to or larger than the maximum sheet passing width W2 as mentioned above. The shielding member 60 is divided into two portions along the longitudinal direction of the center core 58, the two portions of the shielding member 60 being symmetrically shaped with respect to each other. The two divided portions of the shielding member 60 each have a trapezoidal shape in plan view as shown in FIGS. 4A and 4B. As can be seen from there Figures, the length of the shielding member 60 measured along a circumferential direction (or the width measured along the longitudinal direction) is the smallest in an area close to a mid-length part of the center core 58 and the length of the shielding member 60 measured along the circumferential direction thereof gradually increases toward both ends of the center core 58.

Major parts of the two divided portions of the shielding member 60 are arranged on both outsides of a minimum sheet passing width W1 which is perpendicular to a sheet passing direction, and only little parts of the two divided portions of the shielding member 60 extend into an area of the minimum sheet passing width W1. The two divided portions of the shielding member 60 reach slightly outward beyond the maximum sheet passing width W2 at both ends of the center core 58 as illustrated. It is to be noted that the minimum sheet passing width W1 and the maximum sheet passing width W2 are determined according to minimum and maximum printable paper size of the image forming apparatus 1.

As will be recognized from the foregoing discussion, the ratio of the length of the shielding member 60 measured along the circumferential direction to the entire length of the circumference along which the shielding member 60 is rotated varies along a sheet passing width direction in the present embodiment. The ratio of the length (Lc) of the shielding member 60 measured along the circumferential direction to the length (L) of one complete turn of the shielding member 60 is hereinafter referred to as a shielding ratio (=Lc/L). It is apparent from above that this shielding ratio (=Lc/L) is small in regions of the center core 58 closer to the mid-length part thereof and becomes gradually larger outward toward both ends of the center core 58 along the sheet passing width direction. Specifically, the shielding ratio is minimized in the proximity of outer ends of a minimum sheet-conveyed region (i.e., the range of minimum sheet passing width W1) and is maximized at both ends of the center core 58.

The fixing unit 14 is adapted to different paper sizes (sheet passing widths) by varying the position of the shielding member 60 in a continuous or stepwise fashion to partly suppress the value of magnetic flux produced. As an example, the angular position (or the amount of angular displacement) of the shielding member 60 is varied according to the paper size. Specifically, the shielding member 60 is adjusted such that the larger the paper size, the smaller the amount of magnetic flux shielded by the shielding member 60, and on the contrary, the smaller the paper size, the larger the amount of magnetic flux shielded by the shielding member 60, in order to prevent overheating of both lateral end portions of the heat roller 46 and the heating belt 48. While FIGS. 4A and 4B show counterclockwise and clockwise turning directions of the shielding member 60 by arrow, respectively, the fourth paper path 12 may be configured such that the shielding member 60 is allowed to turn in one direction only. Additionally, the sheet passing direction may be opposite to that shown in FIGS. 4A and 4B.

<Rotation Mechanism>

Figure 5A:
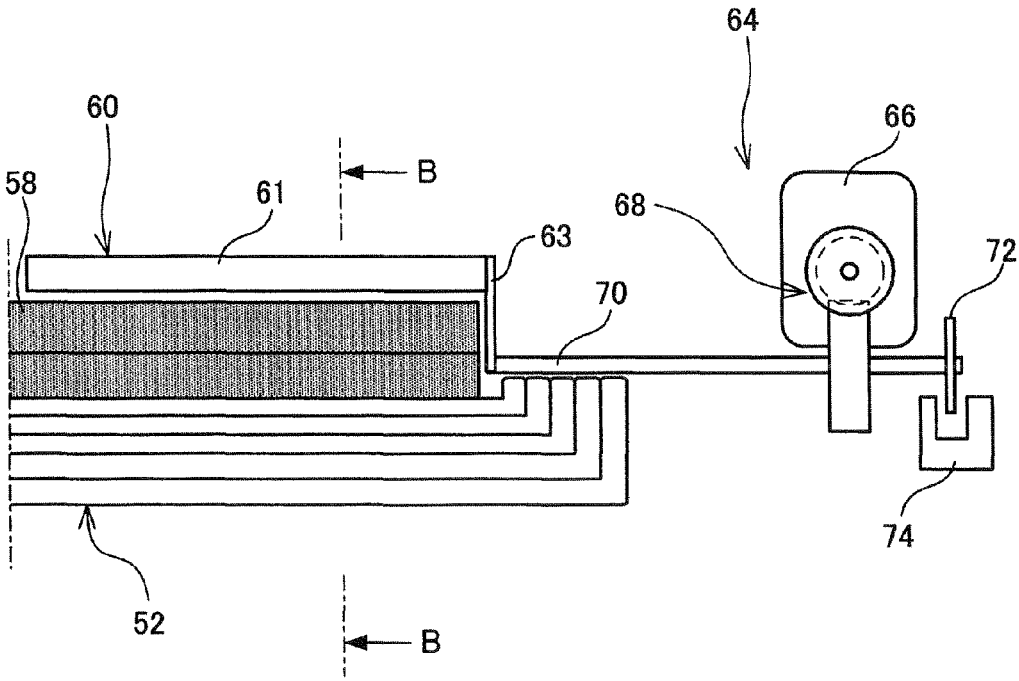
FIG. 5A is a side view showing the structure of a rotation mechanism of the shielding member.
Figure 5B:
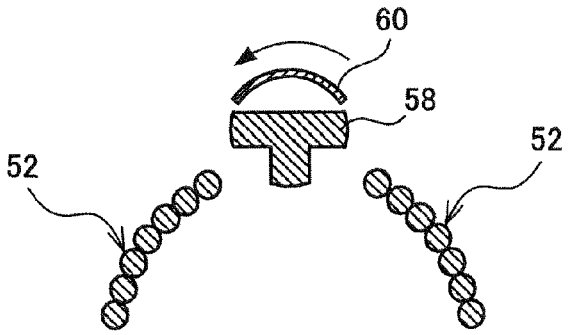
FIG. 5B is a cross-sectional view taken along lines B-B of FIG. 5A showing the working of the shielding member.

Described next with reference to FIGS. 5A and 5B is how the aforementioned rotation mechanism for rotating the shielding member 60 on the outside of the center core 58 is structured. FIG. 5A is a side view showing the structure of the rotation mechanism 64 for rotating the shielding member 60 and FIG. 5B is a cross-sectional view taken along lines B-B of FIG. 5A showing the working of the shielding member 60. It is to be noted that the rotation mechanism 64 constitutes a magnetism adjusting unit.

As shown in FIG. 5A, the rotation mechanism 64 is structured to reduce rotation speed of a stepping motor 66 by means of a reducer mechanism 68, for example, to drive the driving shaft 70 to rotate the shielding member 60. While the reducer mechanism 68 of this embodiment employs a worm gear, for example, the reducer mechanism 68 may be otherwise structured as appropriate. The driving shaft 70 is fitted with a slit disk 72 at an extreme end as shown in FIG. 5A as illustrated. The slit disk 72 is combined with a photointerrupter 74 for detecting the angular position (or the amount of angular displacement from a reference position) of the shielding member 60.

Referring to FIG. 5A, the driving shaft 70 is connected to the side plate 63 of the shielding member 60 as previously mentioned and supports the entirety of the shielding member 60 including the shielding plate 61 via the side plate 63. The angular position of the shielding member 60 can be controlled by the number of driving pulses applied to the stepping motor 66, for instance. The rotation mechanism 64 is associated with a control circuit (not shown) for performing this control operation. The control circuit can be configured with such devices as a controller integrated circuit (IC), an input/output driver and a semiconductor memory. A sensing signal from the photointerrupter 74 is input into the controller IC through the input/output driver, and the controller IC detects the current angular position of the shielding member 60 based on this sensing signal. On the other hand, an unillustrated image forming control unit notifies the controller IC of information concerning a current paper size. On receiving this information, the controller IC reads out information about the angular position of the shielding member 60 suited to the current paper size from the semiconductor memory which is a read-only memory (ROM) and outputs a particular number of driving pulses required for the shielding member 60 to reach the aimed angular position at regular intervals. These driving pulses are applied to the stepping motor 66 via the input/output driver, causing the stepping motor 66 to operate accordingly.

Figure 6B:
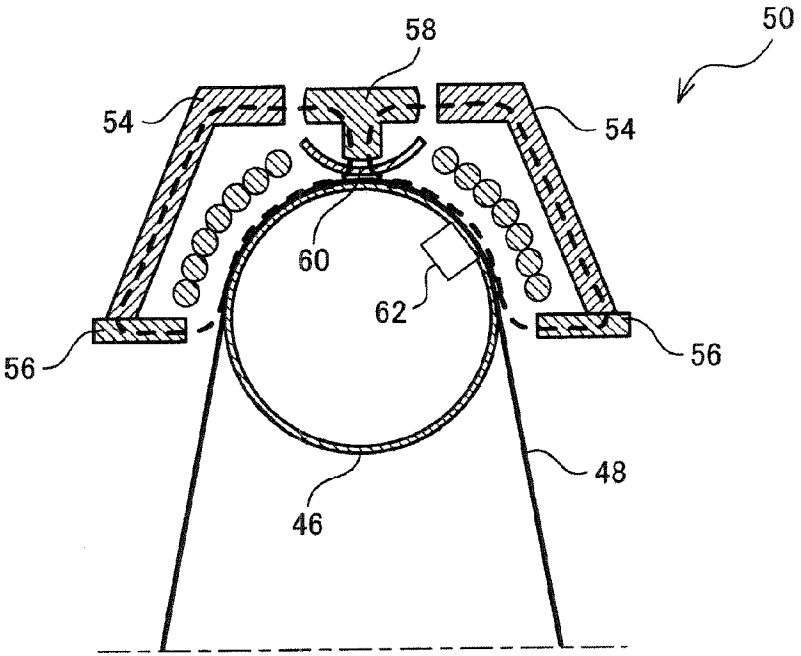
FIGS. 6A and 6B are diagrams showing examples of operation performed as a result of turning action of the shielding member of exemplary structure (1).
Figure 6A:
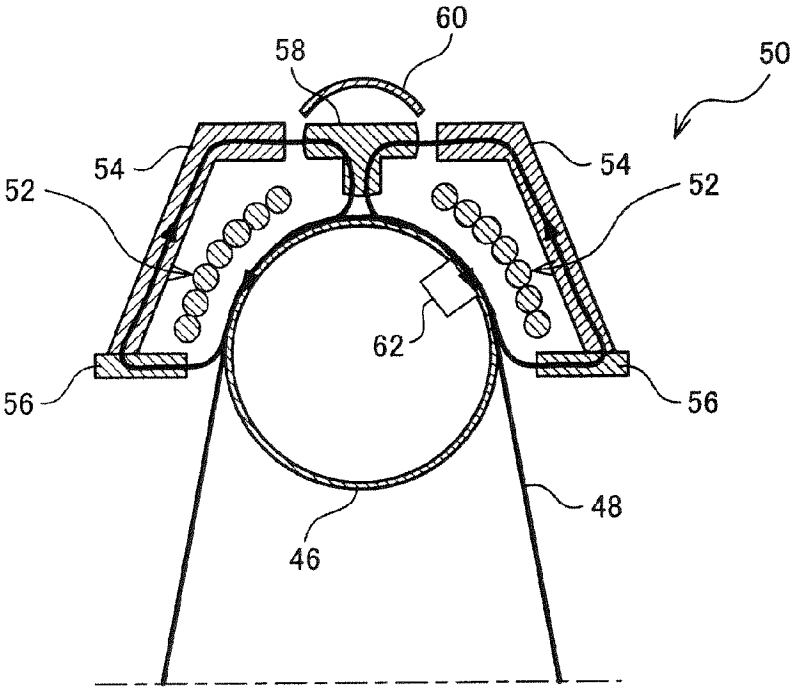

FIGS. 6A and 6B are diagrams showing examples of operation performed as a result of rotating action of the shielding member 60. These examples of operation are individually described below.

FIG. 6A shows the example of operation performed when the shielding member 60 is switched to the retracted position by the rotation mechanism 64. In this case, the magnetic field produced by the induction heating coil 52 passes through the heating belt 48 and the heat roller 46 by way of the side cores 56, the arch cores 54 and the center core 58. Consequently, eddy currents flow in the heat roller 46 and the heating belt 48 made of the ferromagnetic substance, so that the heat roller 46 and the heating belt 48 are heated by Joule heat generated due to resistivities of the respective materials.

FIG. 6B shows the example of operation performed when the shielding member 60 is switched to the shielding position by the rotation mechanism 64. In this case, part of the shielding member 60 exists in the magnetic path outside the minimum sheet-conveyed region, so that generation of the magnetic field is partly suppressed. This serves to reduce the amount of heat generated outside the minimum sheet-conveyed region, thereby preventing overheating of the heat roller 46 and the heating belt 48. Moreover, it is possible to adjust the amount of magnetic flux (magnetic field) shielded by the shielding member 60 by varying the angular position of the shielding member 60 little by little. If the angular position of the shielding member 60 is increased in small steps by rotating the shielding member 60 in the counterclockwise direction from the position shown in FIG. 6B, for example, the magnetic field becomes gradually not shielded on a left side of the fixing unit 14 but the shielding member 60 continues to shield the magnetic field on a right side of the fixing unit 14. Compared to the example of FIG. 6A in which the shielding member 60 is in the retracted position, the magnetic field strength is decreased as a whole so that the amount of heat generated can be lowered.

<Exemplary Structure (2) of Shielding Member>

Figure 7:
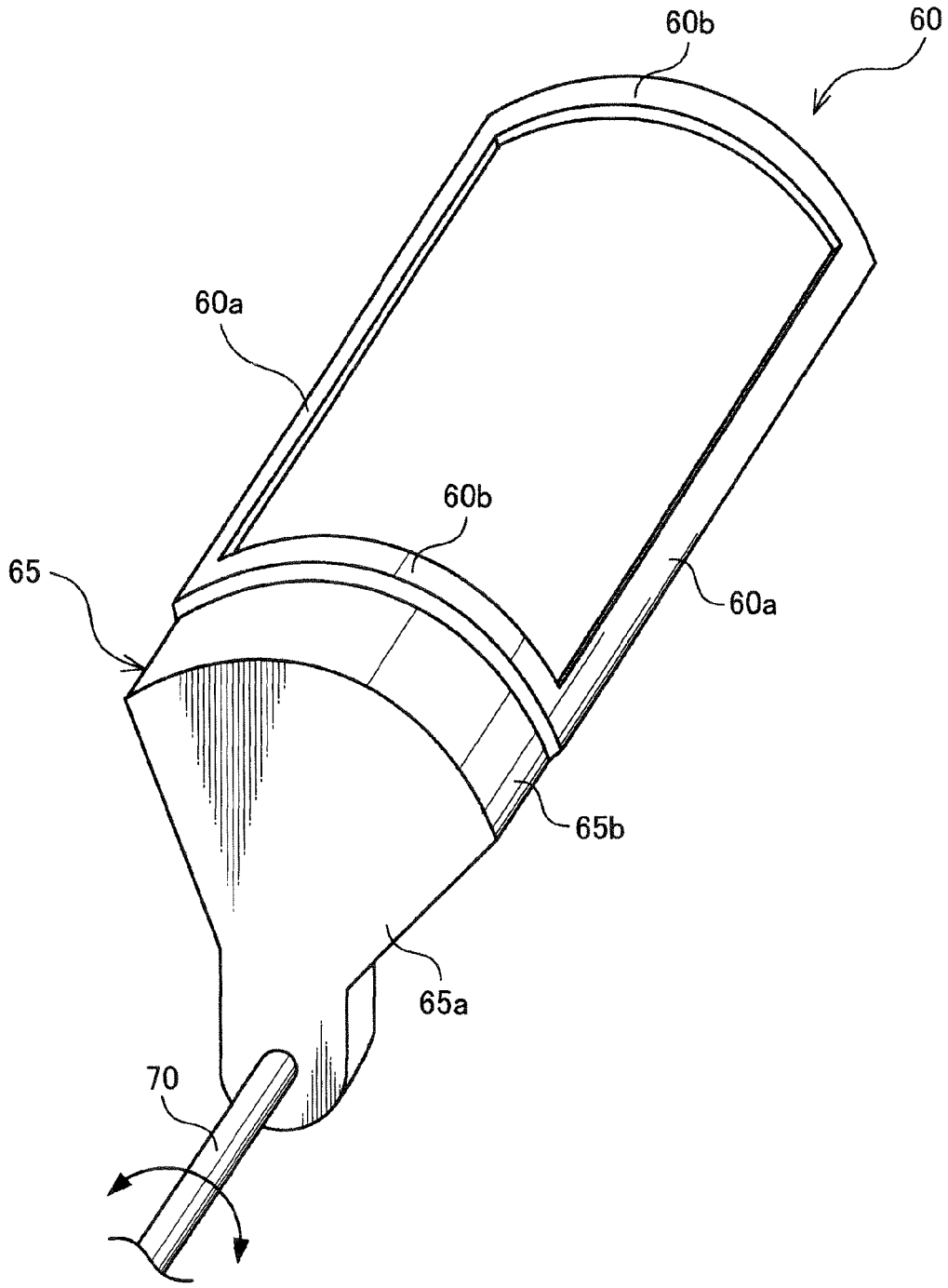
FIG. 7 is a perspective view showing exemplary structure (2) of a generally ring-shaped shielding member.

FIG. 7 is a perspective view showing exemplary structure (2) of a generally ring-shaped shielding member 60 which has four sides including a pair of straight segments 60*a* arranged on opposite sides in a width direction and a pair of ring-shaped portions 60*b* arranged on opposite sides in the longitudinal direction. As in the shielding member 60 with exemplary structure (1) described above, the ring-shaped shielding member 60 is mounted such that portions of the shielding member 60 are arranged on the outside of the minimum sheet passing width at both ends of the center core 58.

The shielding member 60 with this exemplary structure (2) is supported by a supporting member 65 at one longitudinal end, for instance. The supporting member 65 is configured with a fan-shaped side plate 65*a* and an arc-shaped top plate 65*b*, for example, the top plate 65*b* being connected to one of the ring-shaped portions 60*b* along a bottom side thereof. The side plate 65*a* extends downward from the top plate 65*b* as illustrated in FIG. 7 and has an apex to which the aforementioned driving shaft 70 is connected. The shielding member 60 with this exemplary structure (2) is provided with a rotation mechanism 64 which is identical to the rotation mechanism 64 of the foregoing exemplary structure (1) of the shielding member 60.

<Principle of Magnetic Shielding Effect>

Figure 8A:
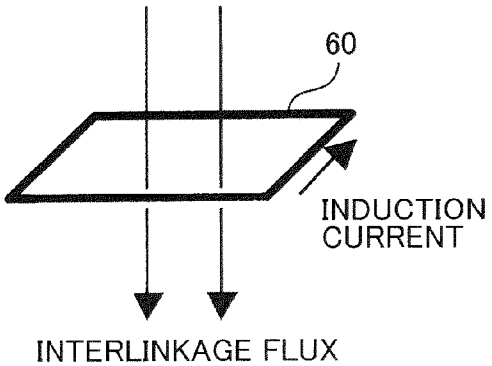
FIGS. 8A, 8B and 8C are conceptual drawings explaining the principle of magnetic shielding effect produced by the ring-shaped shielding member.
Figure 8B:
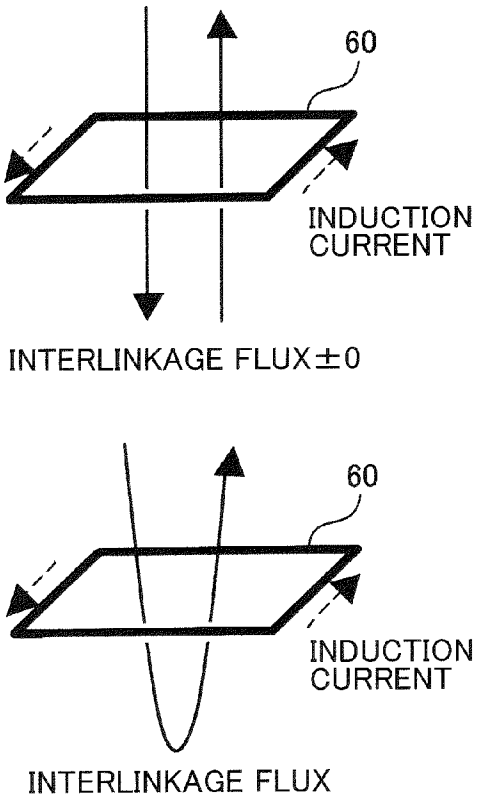
Figure 8C:
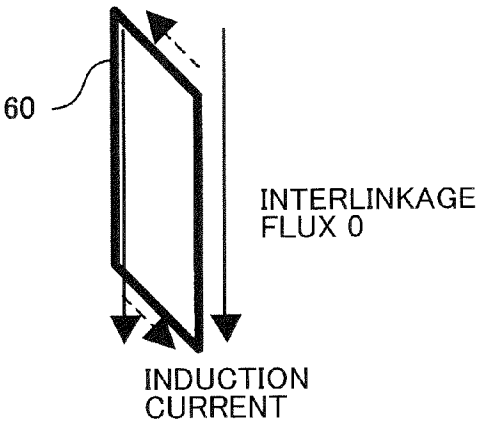

FIGS. 8A, 8B and 8C are conceptual drawings explaining the principle of magnetic shielding effect produced by the ring-shaped shielding member 60. In these Figures, the shielding member 60 is shown in a simplified form using a wire frame model.

Referring to FIG. 8A, if a magnetic field passes through or penetrates a ring surface of the ring-shaped shielding member 60 in a direction perpendicular to the ring surface (imaginary plane), producing interlinkage flux, an induction current flows within the shielding member 60 in a circumferential direction thereof. As a result, due to electromagnetic induction, a magnetic field directed opposite to the penetrating magnetic field is induced. The applied penetrating magnetic field and the induced oppositely directed magnetic field cancel each other out entirely. It will be appreciated from above that the ring-shaped shielding member 60 can shield the magnetic field (magnetic flux) by using the aforementioned magnetic field cancellation effect.

It is now assumed that magnetic fields directed in two opposite directions penetrate the ring surface of the ring-shaped shielding member 60 as shown in an upper part of FIG. 8B and the sum of interlinkage flux is generally zero (±0). In this case, almost no induction current flows within the shielding member 60 so that the shielding member 60 does not produce any significant magnetic field cancellation effect and, thus, the magnetic fields directed in the two opposite directions pass through the shielding member 60. The same situation also occurs when a magnetic field passes through the inside of the shielding member 60 in a U-shaped pattern as shown in a lower part of FIG. 8B. When the shielding member 60 is in the retracted position, the magnetic field is allowed to pass through with the shielding member 60 arranged at a position where the magnetic field does not penetrate the shielding member 60.

Shown in FIG. 8C is a case where a magnetic field (interlinkage flux) is directed generally parallel to the ring surface of the ring-shaped shielding member 60. In this case, almost no induction current flows within the shielding member 60 as in the case of FIG. 8B so that the shielding member 60 does not produce any significant magnetic field cancellation effect. Although this structure is not employed in the present embodiment, it is necessary to greatly displace the shielding member 60 in order to produce a magnetic field environment in a surrounding area of the induction heating coil 52, thus requiring a large movable space for the shielding member 60.

The aforementioned exemplary structure (2) employing the ring-shaped shielding member 60 produces the magnetic shielding effect due to the principle shown in FIG. 8A. Therefore, as is the case with the examples shown in FIGS. 6A and 6B, it is possible to shield the magnetic field (magnetic flux) in an optimal fashion as in exemplary structure (1) described above by displacing the ring-shaped shielding member 60 between the shielding position and the retracted position.

<Exemplary Structure (3) of Shielding Member>

Figure 9:
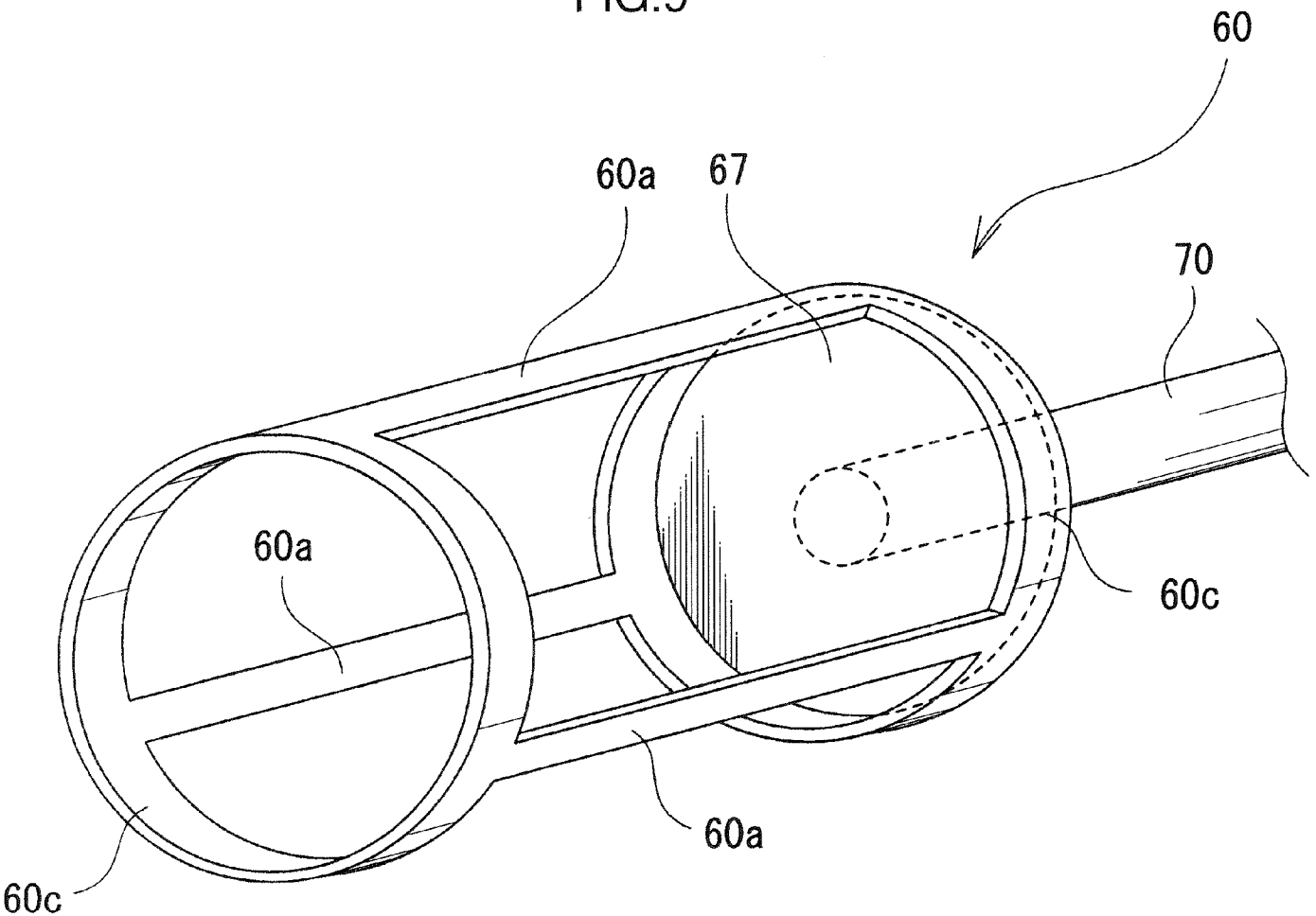
FIG. 9 is a perspective view showing exemplary structure (3) of a shielding member.

FIG. 9 is a perspective view showing exemplary structure (3) of a shielding member 60 which is formed into a reel-like shape as a whole. Specifically, the shielding member 60 of this exemplary structure (3) has a pair of ring segments 60*c* at both longitudinal ends and three straight segments 60*a* interconnecting the two ring segments 60*c*. The three straight segments 60*a* of the shielding member 60 are arranged at specific intervals in a circumferential direction of the ring segments 60*c*. In this exemplary structure (3), a circular side plate 67 is affixed to the inside of one of the ring segments 60*c* and the driving shaft 70 is connected to the side plate 67 at a central position thereof, whereby the entirety of the shielding member 60 is supported by the driving shaft 70 rotatably therewith. As in the aforementioned exemplary structures (1) and (2), portions of the shielding member 60 are arranged on the outside of the minimum sheet passing width at both ends of the center core 58 in this exemplary structure (3) as well.

In this exemplary structure (3) of the shielding member 60, a ring-shaped portion (arch-like segment) is formed in three in a circumferential direction of the shielding member 60 with three ring surfaces defined by those ring-shaped portions. Specifically, the three straight segments 60*a* adjoining in the circumferential direction are so connected to the pair of the ring segments 60*c* that the shielding member 60 has the three ring-shaped portions in the circumferential direction.

<Working of Exemplary Structure (3)>

Figure 10B:
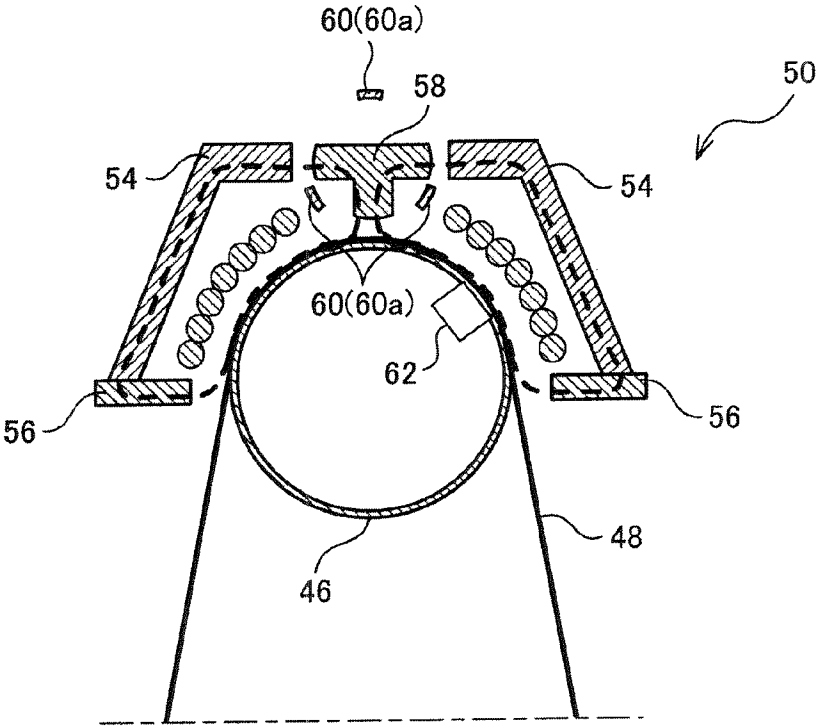
FIGS. 10A and 10B are diagrams showing examples of operation of the shielding member in exemplary structure (3) of FIG. 9.
Figure 10A:
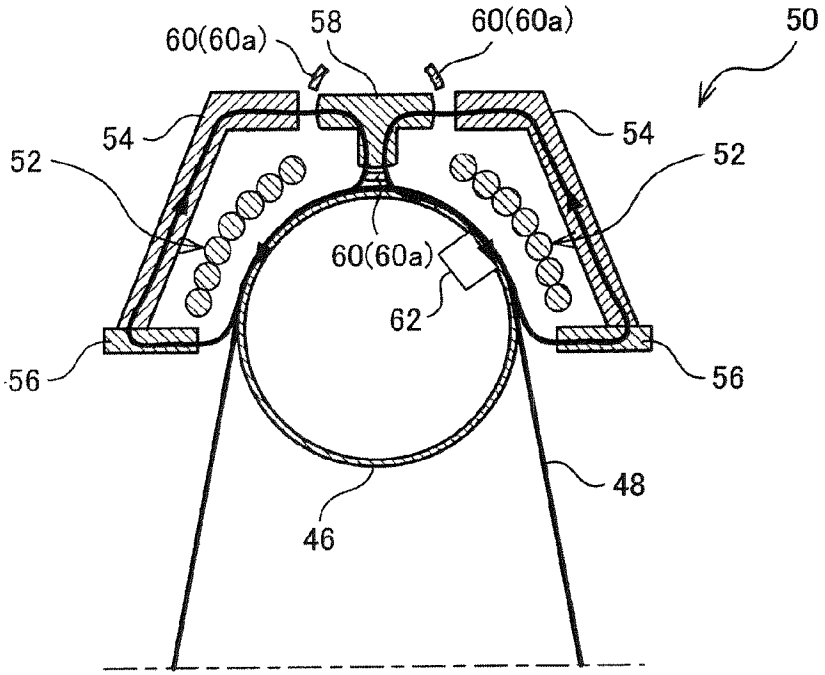

FIGS. 10A and 10B are diagrams showing examples of operation of the shielding member 60 in exemplary structure (3) discussed above.

FIG. 10A shows the example of operation performed when the shielding member 60 is switched to the retracted position by the rotation mechanism 64. In the case of exemplary structure (3), the principle shown in the lower part of FIG. 8A is applied under conditions where the shielding member 60 is set at the retracted position. Specifically, with one of the three straight segments 60*a* of the shielding member 60 aligned with a center line of the induction heating coil 52, the ring-shaped portion of the shielding member 60 arranged on an opposite side (upper side as illustrated) of the heat roller 46 is retracted to the outside of the magnetic field and the magnetic field is caused to pass through the inside of the other two ring-shaped portions in a U-shaped pattern, thereby creating a state in which the shielding member 60 does not produce the magnetic shielding effect. Therefore, the magnetic field passes through the heating belt 48 and the heat roller 46 by way of the side cores 56, the arch cores 54 and the center core 58. Consequently, eddy currents flow in the heat roller 46 and the heating belt 48 made of the ferromagnetic substance, so that the heat roller 46 and the heating belt 48 are heated by Joule heat generated due to resistivities of the respective materials.

FIG. 10B shows the example of operation performed when the shielding member 60 is switched to the shielding position. In this case, one of the ring-shaped portions of the shielding member 60 exists in the magnetic path outside the minimum sheet-conveyed region and the magnetic field passes through the inside of the pertinent ring-shaped portion, so that generation of the magnetic field is partly suppressed due to the principle shown in FIG. 8A. This serves to reduce the amount of heat generated outside the minimum sheet-conveyed region, thereby preventing overheating of the heat roller 46 and the heating belt 48.

<Exemplary Structure (4) of Shielding Member>

Figure 11:
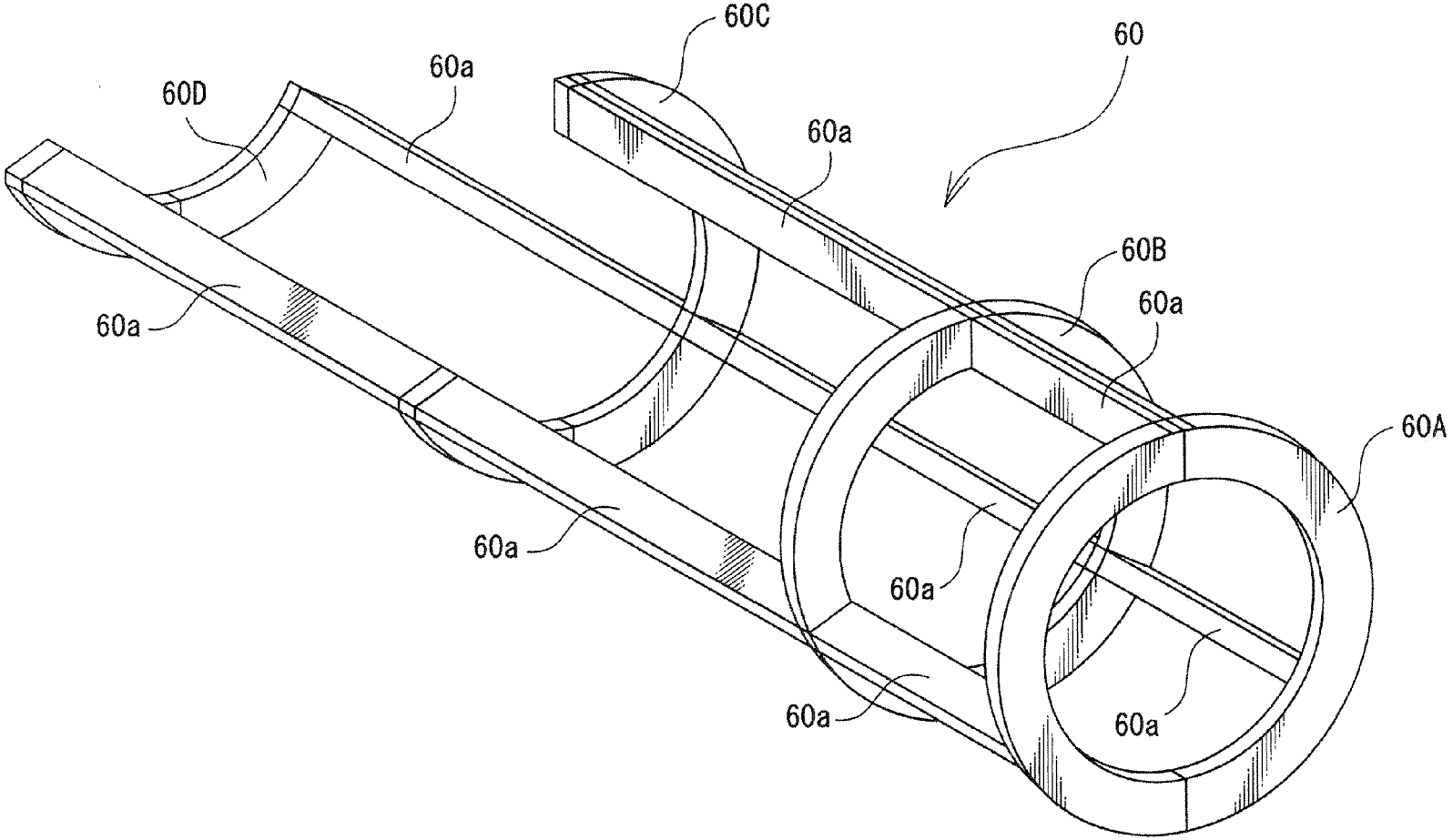
FIG. 11 is a perspective view showing exemplary structure (4) of a shielding member.

FIG. 11 is a perspective view showing exemplary structure (4) of a shielding member 60 which has a structure further developed from the above-described exemplary structure (3). Specifically, the shielding member 60 of this exemplary structure (4) has a ring-shaped plate 60A at one longitudinal end and another ring-shaped plate 60B at a particular distance from the shielding member 60A in the longitudinal direction of the shielding member 60. The shielding member 60 further has an approximately two-third ring-shaped plate 60C at a particular distance from the shielding member 60B in the longitudinal direction of the shielding member 60 and an approximately one-third ring-shaped plate 60D at the opposite longitudinal end of the shielding member 60. Although not illustrated in FIG. 11, a circular side plate 67 is affixed to the ring-shaped plate 60A at one longitudinal end of the shielding member 60 and the driving shaft 70 is connected to the side plate 67 as in the aforementioned exemplary structure (3).

Among the aforementioned plates 60A, 60B, 60C, 60D, the first three plates 60A, 60B, 60C are interconnected by three straight segments 60*a* of the shielding member 60, while the plate 60D at the aforementioned opposite longitudinal end of the shielding member 60 is connected to the adjacent plate 60C by two of the straight segments 60*a*.

Figure 12A:
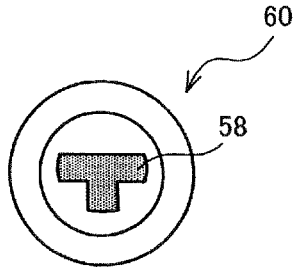
FIGS. 12A, 12B, 12C and 12D are diagrams showing a state in which the shielding member in exemplary structure (4) of FIG. 11 is arranged at an end of a center core.
Figure 12A:
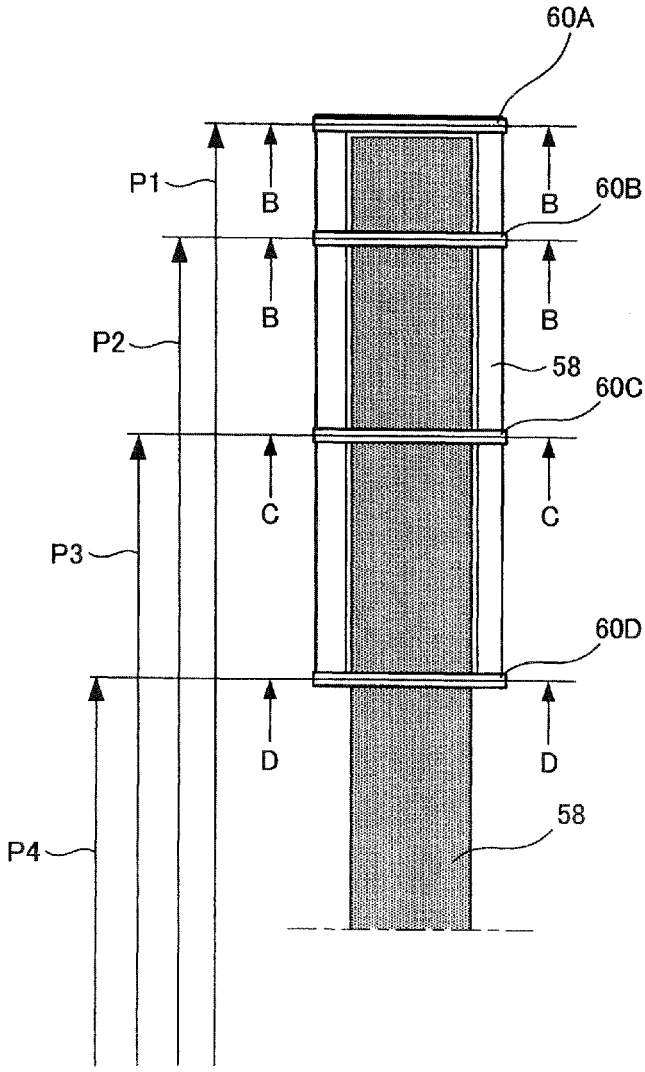
Figure 12B:
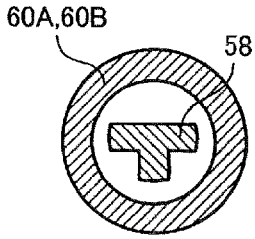
Figure 12C:
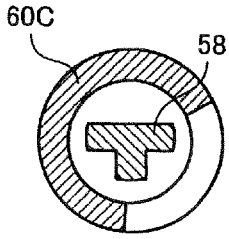
Figure 12D:
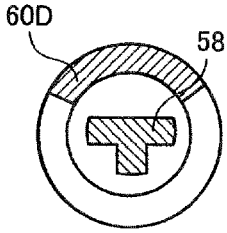

FIG. 12A shows a side view and a plan view of the center core 58, illustrating in particular a state in which the shielding member 60 of exemplary structure (4) is arranged such that portions of the shielding member 60 are arranged at opposite end portions of the center core 58. FIGS. 12B, 12C and 12D are cross-sectional diagrams taken along lines B-B, C-C and D-D of FIG. 12A, respectively.

As shown in FIG. 12A, the shielding member 60 of exemplary structure (4) also has portions arranged at both longitudinal ends of the center core 58 (although only one longitudinal end thereof is shown in FIG. 12A). Referring to FIG. 12A, the plate 60A arranged farthest away from the minimum sheet-conveyed region is at a position corresponding to a maximum paper size P1 (e.g., A3 or A4R size). Similarly, the plate 60B arranged next to the plate 60A is at a position corresponding to a medium paper size P2 (e.g., B4R size), and the plate 60C arranged next to the plate 60B is at a position corresponding to a medium/small paper size P3 (e.g., B4 size). Finally, the plate 60D arranged in the vicinity of the minimum sheet-conveyed region is at a position corresponding to a minimum paper size P4 (e.g., A5R size).

It is seen from FIG. 12B that the plates 60A and 60B of the shielding member 60 are ring-shaped pieces, each having a vacant circular center. Also, it is seen from FIG. 12C that the plate 60C of the shielding member 60 is an approximately two-third ring-shaped member whose one-third ring-shaped empty part is a vacant space unoccupied by nonmagnetic material of the plate 60C.

Additionally, it is seen from FIG. 12D that the plate 60D of the shielding member 60 is an approximately one-third ring-shaped member whose two-third ring-shaped empty part is a vacant space unoccupied by nonmagnetic material of the plate 60D.

<Working of Exemplary Structure (4)>

Examples of operation of the shielding member 60 in exemplary structure (4) are described with reference to FIGS. 13 to 18 which are perspective views showing six different situations which may occur when the shielding member 60 of exemplary structure (4) is used. Arrows shown in bold lines in FIGS. 13 to 18 each represent an induction current produced or a magnetic field passing through the shielding member 60. It is to be noted that members like the side plate 67 and the driving shaft 70 are not shown in these Figures. The individual examples of operation of the shielding member 60 are now described hereinbelow.

<Total Magnetic Shielding at 0° Position>

Figure 13:
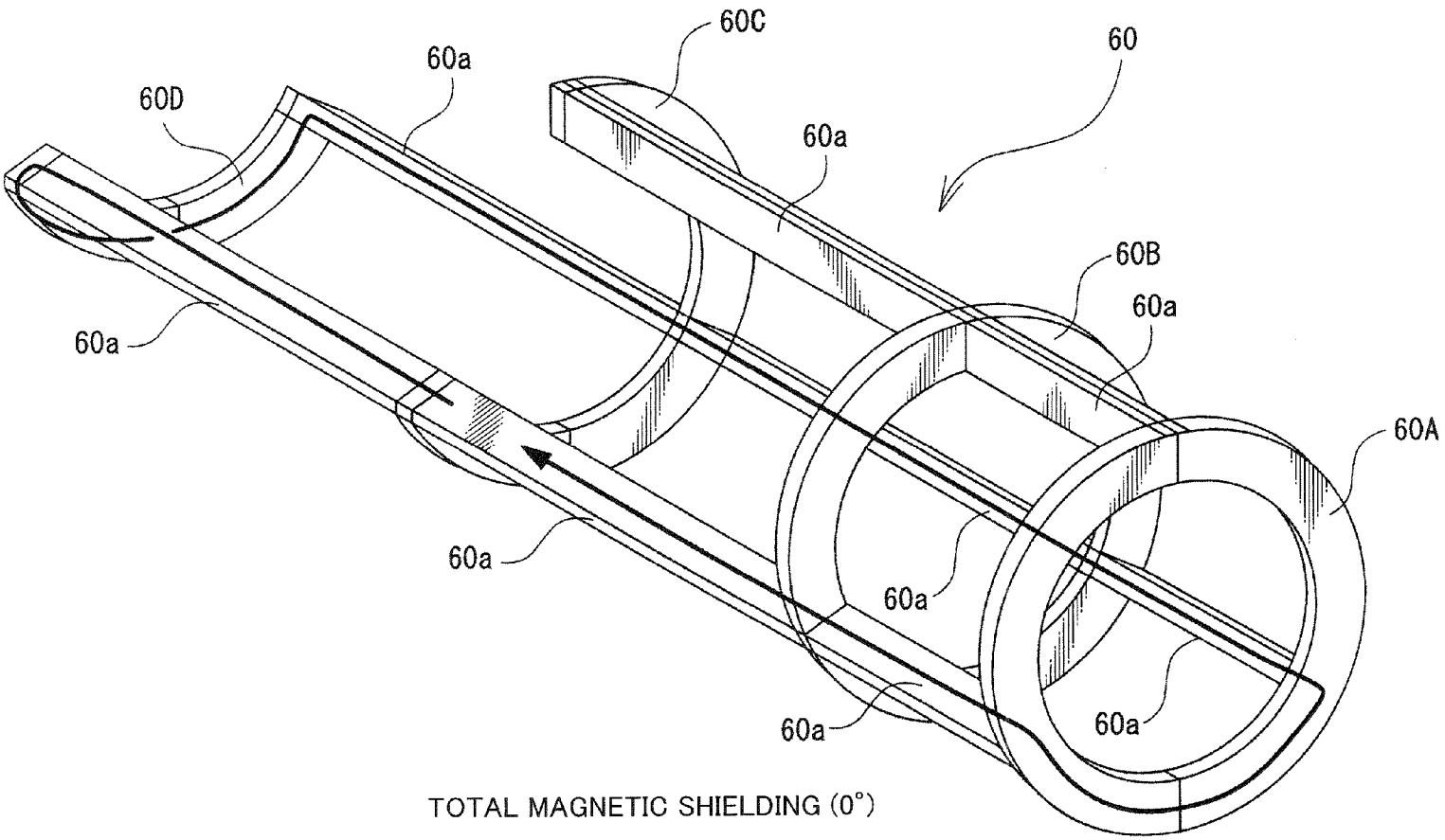
FIG. 13 is a perspective view showing an example of operation performed when a magnetic field is entirely shielded by the shielding member.

FIG. 13 is a perspective view showing the example of operation performed when the magnetic field is entirely shielded by the shielding member 60. It is assumed in the following discussion of the examples of operation that the magnetic field is produced in a direction penetrating the shielding member 60 from top to bottom. Also, in the following discussion, the angular position of the shielding member 60 shown in FIG. 13 in which the magnetic field is entirely shielded is regarded as 0 degrees and the amount of angular displacement of the shielding member 60 is expressed in terms of the rotation angle of the shielding member 60 from the 0-degree position.

If the shielding member 60 is rotated to the angular position of 0 degrees at which the plate 60D is at the bottom of the shielding member 60, it is possible for the shielding member 60 to produce the magnetic shielding effect over an entire surface area along the longitudinal direction of the shielding member 60. Specifically, the plate 60A at one longitudinal end of the shielding member 60, the plate 60D at the opposite longitudinal end thereof and the straight segments 60*a* interconnecting the plates 60A and 60B together form an ring-shaped portion having a maximum size of which entirety can be used for shielding the magnetic field. In this case, it is possible to prevent overheating of the heat roller 46 and the heating belt 48 in a region corresponding to the minimum paper size P4.

<Zero Magnetic Shielding at 60° Position>

Figure 14:
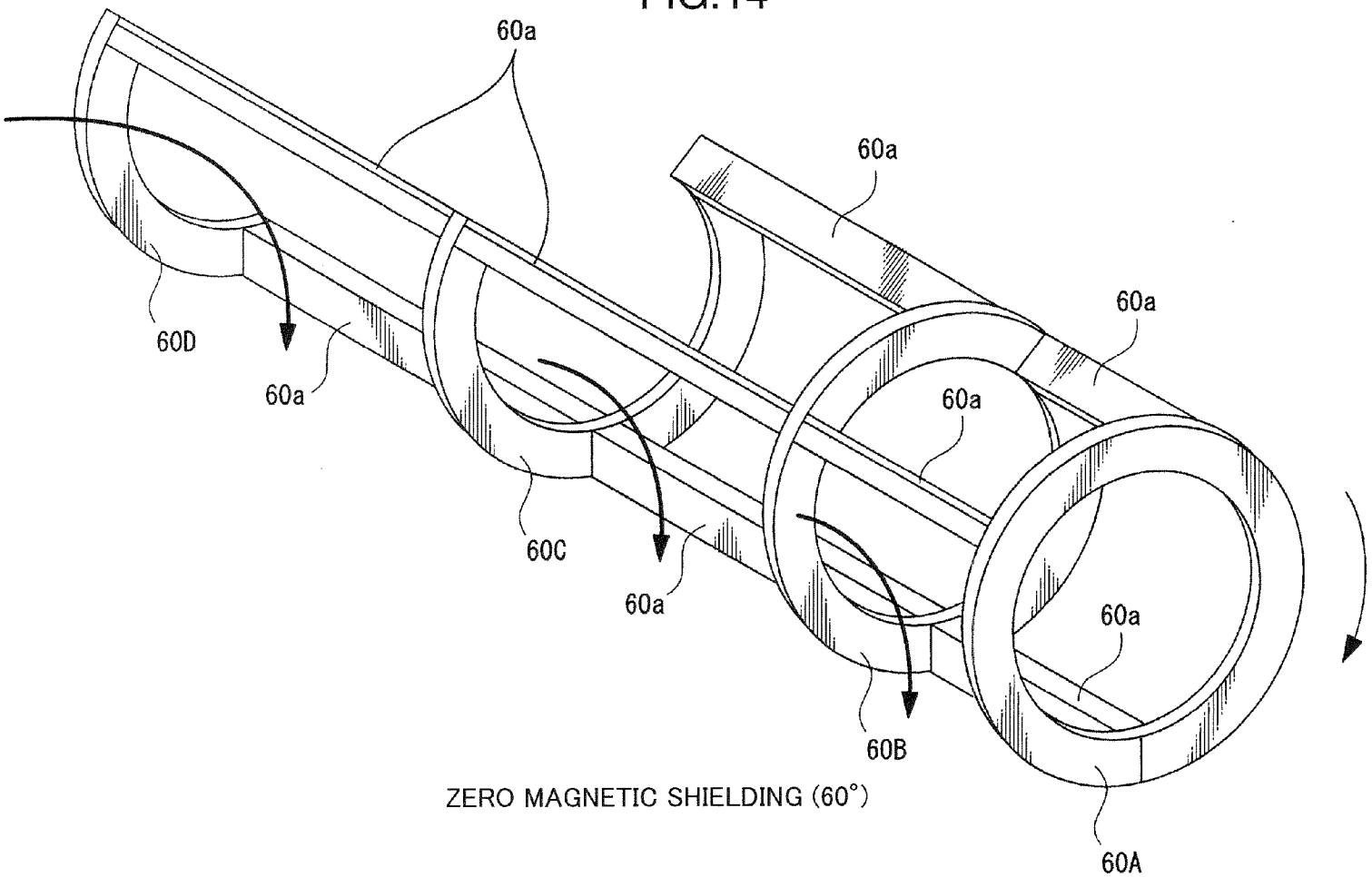
FIG. 14 is a perspective view showing an example of operation performed when the shielding member is rotated clockwise by 60 degrees from the angular position shown in FIG. 13.

FIG. 14 is a perspective view showing the example of operation performed when the shielding member 60 is rotated clockwise by 60 degrees from the angular position shown in FIG. 13. In this case, one of the straight segments 60*a* of the shielding member 60 is aligned with the center line of the induction heating coil 52 (as shown in FIG. 8A), so that the shielding member 60 is at the retracted position and does not produce any magnetic shielding effect.

<Magnetic Shielding for Medium/small Size at 120° Position>

Figure 15:
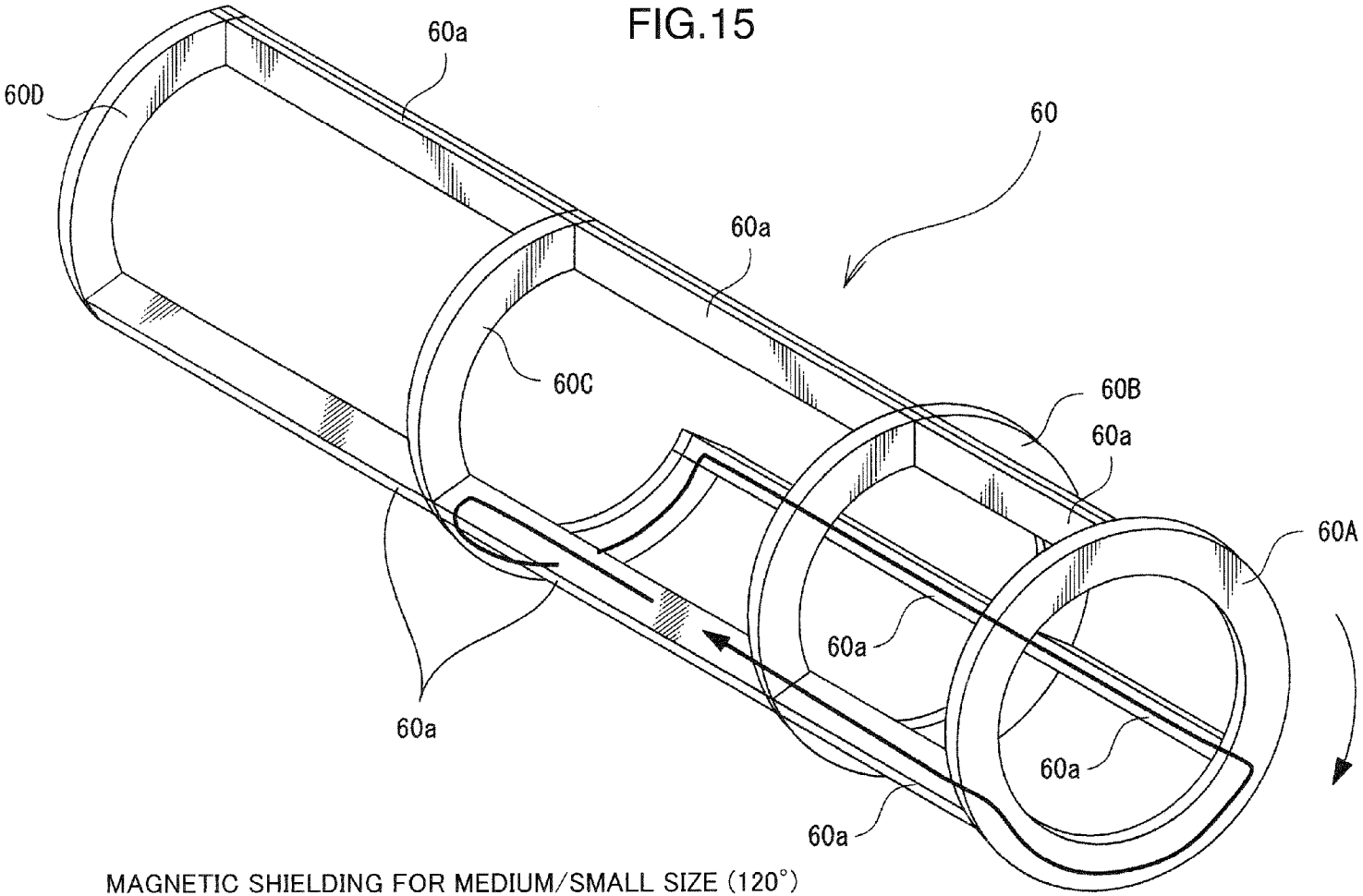
FIG. 15 is a perspective view showing an example of operation performed when the shielding member is rotated clockwise by 120 degrees from the angular position shown in FIG. 13.

FIG. 15 is a perspective view showing the example of operation performed when the shielding member 60 is rotated clockwise by 120 degrees from the angular position shown in FIG. 13. In this case, it is possible for the shielding member 60 to produce the magnetic shielding effect by an ring-shaped portion formed between the plates 60A and 60B. This example of operation can prevent overheating of the heat roller 46 and the heating belt 48 in a region corresponding to the medium/small paper size P3, for example.

<Zero Magnetic Shielding at 180° Position>

Figure 16:
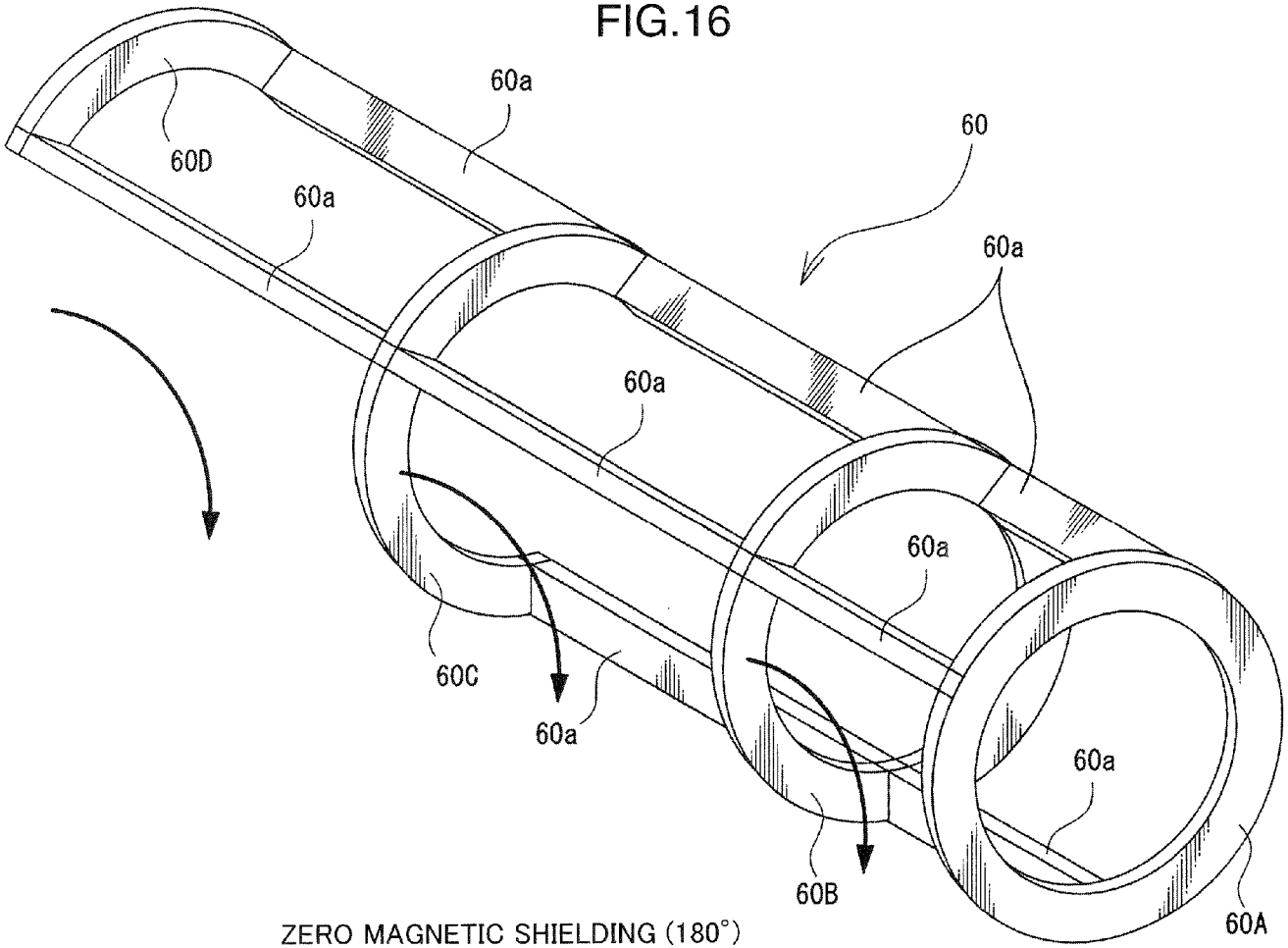
FIG. 16 is a perspective view showing an example of operation performed when the shielding member is rotated clockwise by 180 degrees from the angular position shown in FIG. 13.

FIG. 16 is a perspective view showing the example of operation performed when the shielding member 60 is rotated clockwise by 180 degrees from the angular position shown in FIG. 13. In this case, one of the straight segments 60*a* of the shielding member 60 is aligned with the center line of the induction heating coil 52 (as shown in FIG. 8A) as in the example of FIG. 14, so that the shielding member 60 is at the retracted position and does not produce any magnetic shielding effect.

<Magnetic Shielding for Medium Size at 240° Position>

Figure 17:
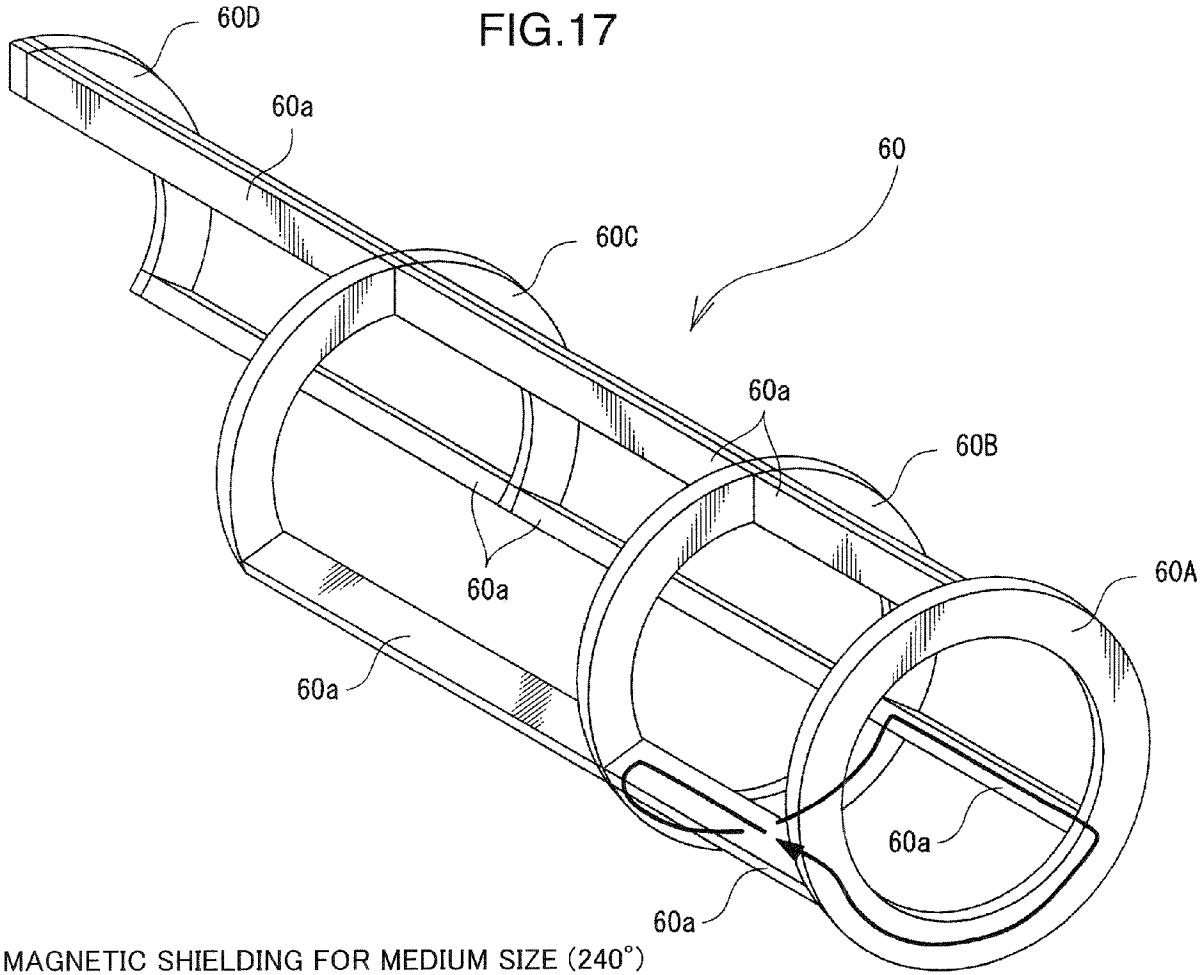
FIG. 17 is a perspective view showing an example of operation performed when the shielding member is rotated clockwise by 240 degrees from the angular position shown in FIG. 13.

FIG. 17 is a perspective view showing the example of operation performed when the shielding member 60 is rotated clockwise by 240 degrees from the angular position shown in FIG. 13. In this case, it is possible for the shielding member 60 to produce the magnetic shielding effect by an ring-shaped portion formed between the plates 60A and 60B. This example of operation can prevent overheating of the heat roller 46 and the heating belt 48 in a region corresponding to the medium paper size P2, for example.

<Zero Magnetic Shielding at 300° Position>

Figure 18:
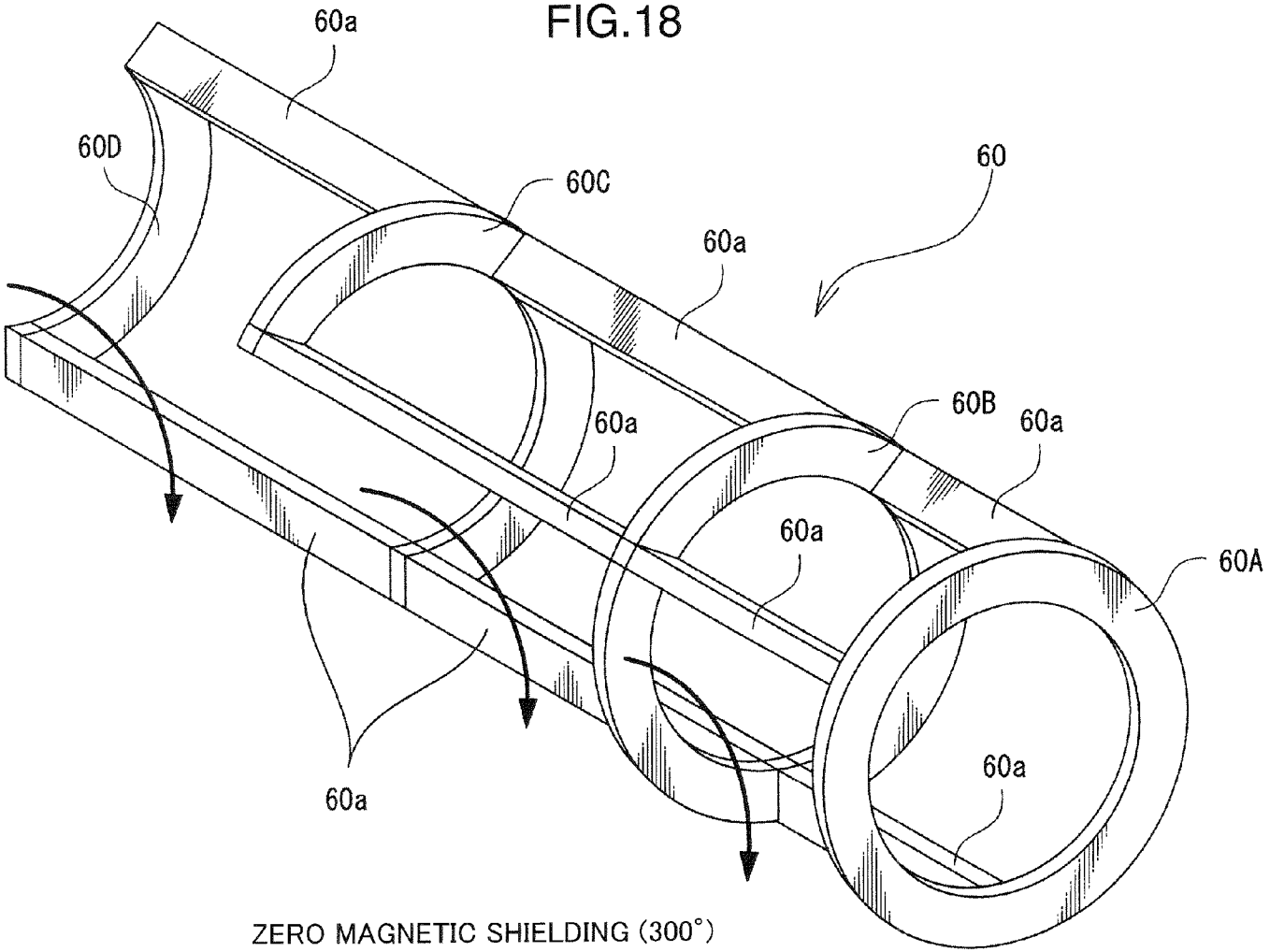
FIG. 18 is a perspective view showing an example of operation performed when the shielding member is rotated clockwise by 300 degrees from the angular position shown in FIG. 13.

FIG. 18 is a perspective view showing the example of operation performed when the shielding member 60 is rotated clockwise by 300 degrees from the angular position shown in FIG. 13. In this case, one of the straight segments 60*a* of the shielding member 60 is aligned with the center line of the induction heating coil 52 (as shown in FIG. 8A) as in the example of FIGS. 14 and 16, so that the shielding member 60 is at the retracted position and does not produce any magnetic shielding effect. It is to be noted that in the cases where no magnetic shielding is produced with the shielding member 60 set at the angular position of 60, 180 or 300 degrees from the angular position shown in FIG. 13, this example of operation can prevent overheating of the heat roller 46 and the heating belt 48 in a region corresponding to the maximum paper size P1.

<Other Exemplary Structures>

Figure 19:
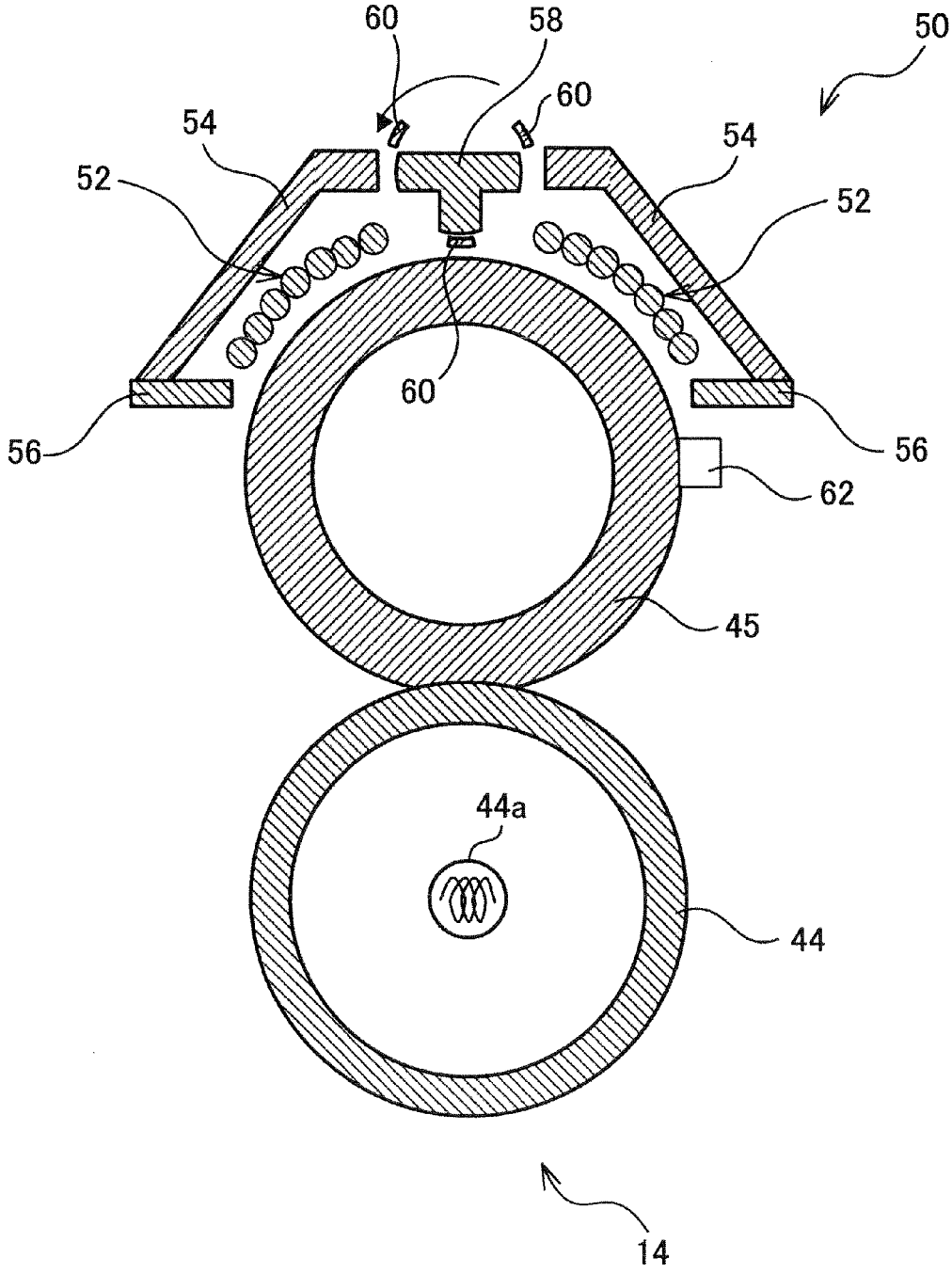
FIG. 19 is a diagram showing another exemplary structure of a fixing unit.

FIG. 19 is a diagram showing another exemplary structure of a fixing unit 14 configured to fix the toner image by a combination of a pressing roller 44 and a fixing roller 45 without using the earlier-described heating belt. This fixing unit 14 is configured such that the same magnetic material as used for forming the aforementioned heating belt 48 is wound around a curved outer surface of the fixing roller 45 and a layer of the magnetic material is heated by the induction heating coil 52. In this exemplary structure, the thermistor 62 is mounted on the outside of the fixing roller 45 at a position facing the magnetic material layer. While FIG. 19 shows the shielding member 60 of exemplary structures (3) and (4) described earlier, the shielding member 60 of exemplary structure (1) or (2) may be adopted instead. The fixing unit 14 of this exemplary structure is otherwise the same as previously described. It is possible to switch the shielding member 60 between the shielding position and the retracted position by rotating the shielding member 60 as thus far discussed.

Figure 20:
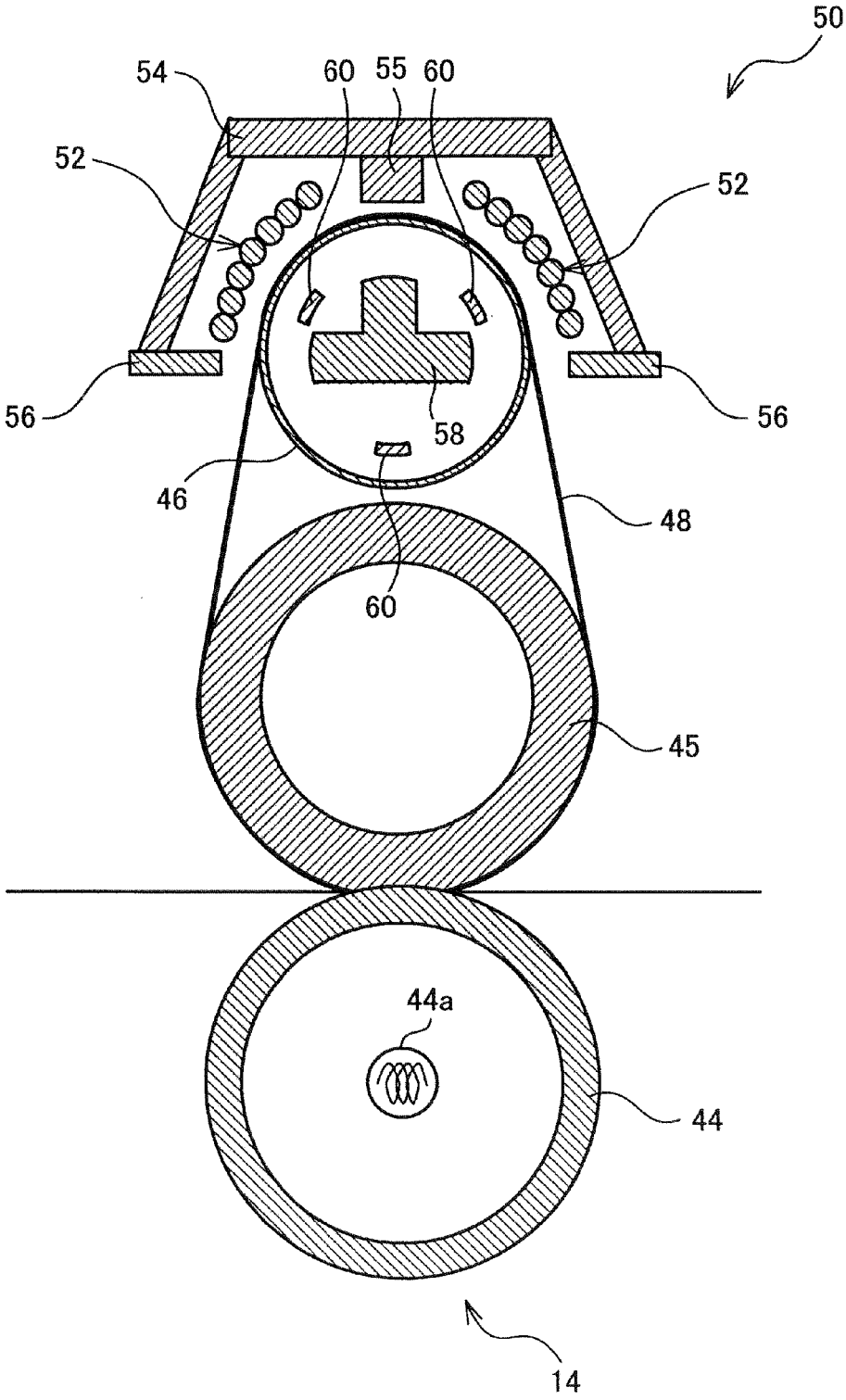
FIG. 20 is a diagram showing still another exemplary structure of a fixing unit.

FIG. 20 is a vertical cross-sectional diagram showing another example of the structure of a fixing unit 14 which differs from the aforementioned structures in that a heat roller 46 is made of a nonmagnetic metallic material (such as stainless steel) and the center core 58 and the shielding member 60 are provided inside the heat roller 46. In addition, the two arch cores 54 shown in FIG. 2 are joined together at the middle into a single arch core 54 and an intermediate core 55 is provided below the arch core 54 as illustrated.

When the heat roller 46 is made of a nonmagnetic metallic material as mentioned above, a magnetic field generated by the induction heating coil 52 passes through the side cores 56, the arch core 54 and the intermediate core 55, penetrates the heat roller 46 and reaches the inside of the center core 58. In the fixing unit 14 thus structured, the heating belt 48 is heated by induction heating due to the penetrating magnetic field.

If a ring-shaped portion of the shielding member 60 is switched to a position facing the intermediate core 55 (i.e., the shielding position) as shown in FIG. 20 in this exemplary structure, the magnetic field is interrupted, making it possible to prevent overheating outside the minimum sheet-conveyed region. On the other hand, the shielding member 60 is at the retracted position when the shielding member 60 is in a state where the magnetic field does not pass through the ring-shaped portion of the shielding member 60. In this case, the shielding member 60 does not produce any magnetic shielding effect and the heating belt 48 heated by induction heating within a maximum sheet-conveyed region. Here again, while FIG. 20 shows the shielding member 60 of exemplary structures (3) and (4) described earlier, the shielding member 60 of exemplary structure (1) or (2) may be adopted instead.

Figure 21:
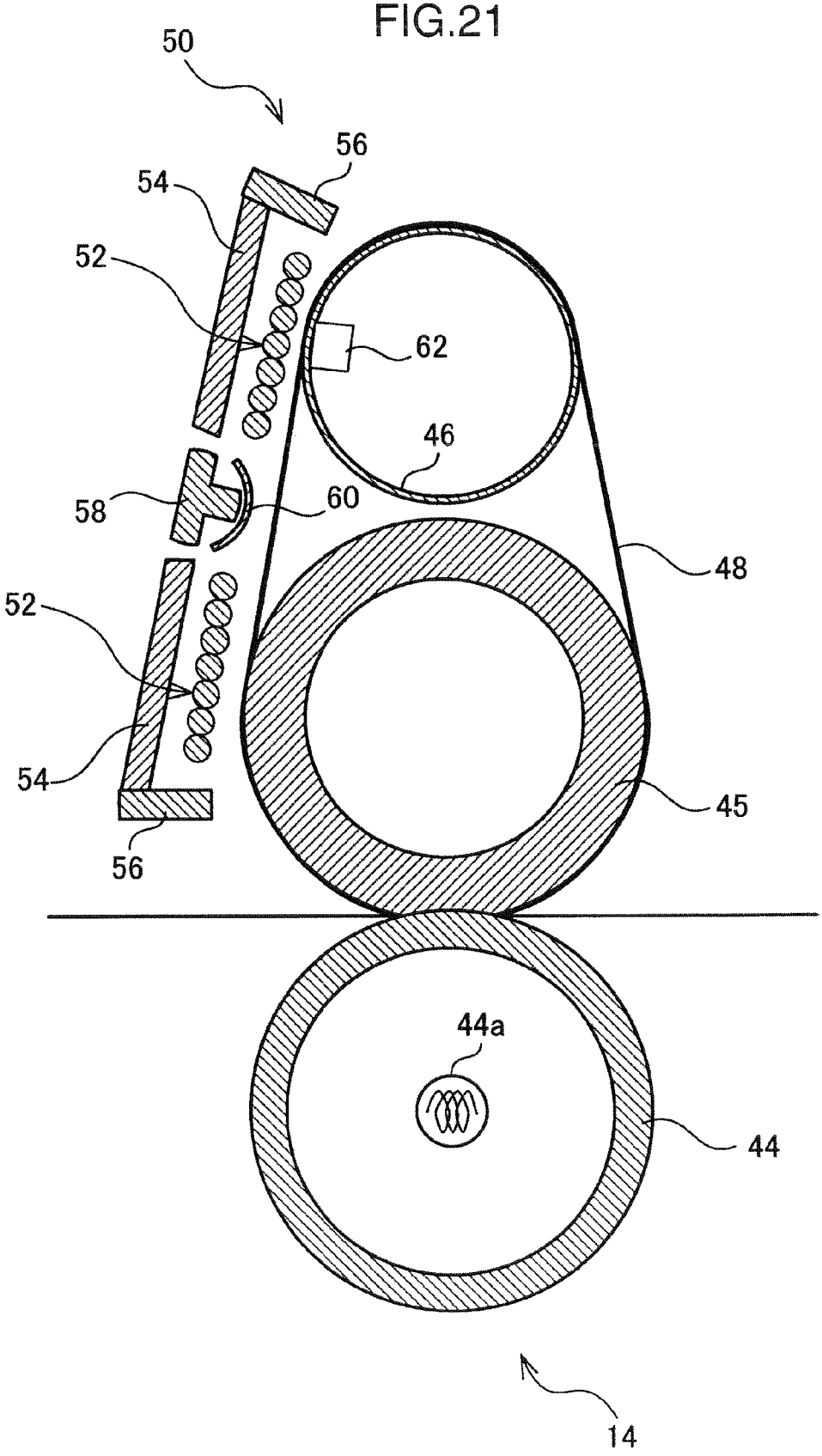
FIG. 21 is a diagram showing another exemplary structure of an induction heating coil.

FIG. 21 is a diagram showing another exemplary structure of an IH coil unit 50. In this exemplary structure, induction heating is performed in a flat portion of the heating belt 48 between the fixing roller 45 and the heat roller 46, and not in arc-shaped portions thereof. It is possible to shield the magnetic field by rotating the shielding member 60 in the same fashion as thus far discussed. While FIG. 21 shows the shielding member 60 of exemplary structure (1) described earlier, the fixing unit 14 of this exemplary structure may employ a different arrangement, such as one of exemplary structures (1) through (4).

It is to be pointed out that the present invention is not limited to the above-described arrangements of the preferred embodiment but is applicable in variously varied forms. For example, the shielding member 60 is not limited to a trapezoidal or rectangular shape in plan view but may be formed into a triangular shape. Also, the ring-shaped shielding member 60 may be made of plural segments divided along the sheet passing width direction.

Additionally, while copper (oxygen-free copper) is used as the material for forming the shielding member 60 in the foregoing preferred embodiment, the shielding member 60 may be made of other kinds of nonmagnetic metallic material (such as stainless steel or aluminum).

Moreover, the above-described individual members including the arch cores 54 and the side cores 56 are not limited to those of the foregoing embodiment but may be modified as appropriate with respect to specific arrangements and structures.

While the image forming apparatus 1 of the preferred embodiments has thus far been described with reference to the drawings, the image forming apparatus 1 can be summarized as having the following preferable features.

The image forming apparatus preferably includes an image forming section for forming a toner image and transferring the toner image onto a sheet, and a fixing unit including a heating member and a pressing member, and fixing the toner image onto the sheet while nipping and conveying the sheet between the heating member and the pressing member. The fixing unit further includes a coil arranged along an outer surface of the heating member and generating a magnetic field, a first core arranged opposite the heating member with respect to the coil and forming a magnetic path, a second core so fixed between the first core and the heating member with respect to a direction in which the coil generates the magnetic field, as to form the magnetic path together with the first core, a shielding member positioned outward of the second core and shielding the magnetism in the magnetic path, and a magnetism adjusting unit moving the shielding member outward of the second core to switch the position of the shielding member between a shielding position where the shielding member shields the pass of the magnetism and a retracted position where the shielding member permits the pass of the magnetism.

The image forming apparatus structured as mentioned above employs an external IH system in which the heating member is heated by induction heating with the aid of the magnetic field produced by the coil to fuse the toner image, so that it is not necessary to provide any particular heating device within the heating member. Also, since the first core is arranged in an area surrounding the coil for forming the magnetic path along which the magnetic field produced by the coil is guided and the second core is arranged simply between the first core and the heating member, the aforementioned structure of the invention does not require an undesirably large space as a whole.

In the image forming apparatus thus structured, there is not provided a mechanism for magnetic shielding inside the heating member. It is therefore possible to lower total heat capacity and achieve a reduction in warm-up time of the fixing unit that much. Although the image forming apparatus employs the external IH system, the only movable component used in the external IH system is the aforementioned shielding member, so that it is possible to reduce the movable range of each member as a whole. Furthermore, as the movable component (shielding member) can be reduced in weight, it is possible to achieve a reduction in size of the fixing unit and eventually a reduction in overall size of the image forming apparatus. Moreover, even when a magnetic shielding mechanism is provided inside the heating member, it is still possible to reduce the total heat capacity because components like the coil are arranged outside the heating member.

Especially in the aforementioned image forming apparatus of the invention, it is possible to regulate the heat capacity of the heating member by simply moving the shielding member on the outside of the second core. Specifically, when the shielding member is shifted to the shielding position by the magnetism adjusting unit, the magnetic field produced by the coil and guided by the second core induces eddy currents which flow in the heating member, thereby performing the induction heating operation. On the other hand, when the shielding member is shifted to the retracted position by the magnetism adjusting unit, magnetic reluctance increases and magnetic field strength decreases within the magnetic path, thereby lowering the heat capacity of the heating member. Therefore, it is not necessary to move any of the cores toward and apart from the heating member for regulating the heat capacity of the heating member, making it possible to achieve space savings that much. Additionally, as it is not necessary to provide any core for magnetic shielding or any electrically conductive member for adjusting the magnetic field within the heating member, the aforementioned structure of the invention serves to avoid an increase in heat capacity and achieve a reduction in warm-up time of the fixing unit.

In the image forming apparatus structured as mentioned above, it is preferable that the magnetism adjusting unit rotates the second core along an outer periphery of the second core to switch the shielding member between the shielding position and the retracted position.

In the image forming apparatus thus structured, the movable range of the heating member is limited to the vicinity of the second core, making it possible to achieve space savings that much. Also, as the shielding member can be moved by rotary motion thereof, it is possible to simplify the structure that much.

In the image forming apparatus structured as mentioned above, it is preferable that the heating member has a sheet-conveyed region through which the sheet is conveyed, and is heatable in a width direction of the sheet over the entire sheet-conveyed region by induction heating by the coil, and the second core extends in the width direction of the sheet to form the magnetic path over the entire sheet-conveyed region, and the shielding member is positioned outward of the sheet-conveyed region set to a minimum with respect to the width direction of the sheet.

In the image forming apparatus thus structured, it is possible to prevent overheating of such members as the heating member when it is not necessary to heat the outside of the minimum sheet-conveyed region by switching the shielding member between the shielding position and the retracted position by means of the magnetism adjusting unit according to the paper size.

In the image forming apparatus structured as mentioned above, it is preferable that when the ratio of the length of the shielding member in the rotation direction of the shielding member relative to the length of the shielding member attained by one complete rotation thereof is defined as a shielding ratio, the shielding ratio varies in the width direction of the sheet. It is more preferable that the shielding ratio decreases in the width direction of the sheet from an end of the second core toward a central portion thereof.

In the image forming apparatus thus structured, when the shielding member is set at the shielding position, the amount of magnetic flux shielded by the shielding member decreases in areas where the shielding ratio is small. On the contrary, when the shielding member is set at the retracted position, the amount of magnetic flux shielded by the shielding member increases in areas where the shielding ratio is large. It is possible to vary the shielding ratio along the width direction (sheet passing width direction) of the sheet by varying the shielding ratio along the sheet passing width direction as mentioned above. In particular, if the shielding ratio is varied in a continuous or stepwise fashion, it is possible to alter a range where the heating member is heated by induction heating in a continuous or stepwise fashion by finely adjusting the angular position of the shielding member in discrete steps.

In the image forming apparatus structured as mentioned above, it is preferable that the shielding member is constituted by a pair of thin-plate members formed by bending in an arcuate shape along an outer periphery of the second core, and each of the thin-plate members extending in the width direction of the sheet from the corresponding one of ends of the second core toward a central portion thereof, and the length of each thin-plate member measured in a circumferential direction thereof decreases from the corresponding one of the ends of the second core toward the central portion thereof.

In the image forming apparatus structured as mentioned above, it is preferable that the shielding member includes a ring-shaped frame made of a nonmagnetic metallic material and a ring surface defined by the ring-shaped frame to face an outer periphery of the second core, and the magnetism adjusting unit adjusts the position of the ring surface relative to the outer periphery of the second core to switch the position of the shielding member between the shielding position and the retracted position. The ring surface of the shielding member may be employed in a plural number along the outer periphery of the second core. The ring surfaces may have different lengths in the width direction of the sheet.

In the image forming apparatus thus structured, if a magnetic field perpendicular to the ring surface passes through, or penetrates, the shielding member, eddy currents flow within the shielding member in a circumferential direction thereof. As a result, due to electromagnetic induction, a magnetic field directed opposite to the penetrating magnetic field is induced. The applied penetrating magnetic field and the induced oppositely directed magnetic field cancel each other out, whereby the shielding member can prohibit passage of the magnetic field. On the other hand, if magnetic fields directed in two opposite directions penetrate the ring surface of the ring-shaped shielding member or a magnetic field passes through the inside of the shielding member in a U-shaped pattern, the shielding member does not produce any magnetic shielding effect.

The inventors of the present invention have undertook an intensive study of the shielding member, focusing particularly on the above-described properties of the shielding member, and devised a fixing unit whose shielding member employs a space-saving mechanism, in which the shielding member produces the magnetic shielding effect when set at the shielding position where the magnetic field is allowed to pass through the ring-shaped frame, and the shielding member allows passage of the magnetic field when set at the retracted position where the magnetic field is not allowed to pass through the ring-shaped frame. Also, if the shielding member is ring-shaped, it is possible to achieve a reduction in weight of the shielding member and thus lower motive power (power consumption) required for moving the shielding member.

In the image forming apparatus structured as mentioned above, it is preferable that the coil is arranged to surround the heating member, and the first core are divided into core elements arranged on both sides of a central part of the coil, and the second core is arranged at a position where the magnetic path joins to the central part of the coil after passing the core elements of the first core on both sides thereof.

While the shielding member is arranged on the outside of the heating member in the aforementioned image forming apparatus, this structure may be modified such that the shielding member is arranged on the inside of the heating member. In this case, the heating member needs to be made of a nonmagnetic metallic material. The coil is arranged to surround the heating member in this case as well.

Even when the shielding member is arranged on the inside of the heating member, it is possible to cause the heating member to produce the magnetic shielding effect by shifting the shielding member between the shielding position and the retracted position within the heating member and create an environment suitable for successful warm-up operation.

Preferably, the shielding member is made of copper. Since copper has low electrical resistance and low permeability, it is possible to cause the heating member to produce the magnetic shielding effect by using copper in the shielding member.

Still preferably, the shielding member has a thickness within the range of 0.5 mm to 3 mm. Specifically, the shielding member efficiently shields the magnetic field while suppressing generation of Joule heat from the shielding member itself, the shielding member needs to be made of material having as low a resistivity (electrical resistance) as possible. If the shielding member has the thickness falling within the aforementioned range, it is possible to obtain good electrical conductivity and sufficient magnetic shielding effect by lowering the resistivity of the shielding member. This structure serves also to achieve a reduction in weight of the shielding member.

This application is based on Japanese patent application serial No. 2008-196801, filed in Japan Patent Office on Jul. 30, 2008, the contents of which is hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

an image forming section for forming a toner image and transferring the toner image onto a sheet;

a fixing unit including a heating member and a pressing member, and fixing the toner image onto the sheet while nipping and conveying the sheet between the heating member and the pressing member, the fixing unit further including:

a coil arranged along an outer surface of the heating member and generating a magnetic field;

a first core arranged opposite the heating member with respect to the coil and forming a magnetic path;

a second core so fixed between the first core and the heating member with respect to a direction in which the coil generates the magnetic field, as to form the magnetic path together with the first core;

a shielding member positioned outward of the second core and shielding the magnetism in the magnetic path; and a magnetism adjusting unit moving the shielding member outward of the second core to switch the position of the shielding member between a shielding position where the shielding member shields the pass of the magnetism and a retracted position where the shielding member permits the pass of the magnetism, wherein the shielding member includes a ring-shaped frame made of a nonmagnetic metallic material and a ring surface defined by the ring-shaped frame to face an outer periphery of the second core; and the magnetism adjusting unit adjusts the position of the ring surface relative to the outer periphery of the second core to switch the position of the shielding member between the shielding position and the retracted position.

2. The image forming apparatus according to claim 1, wherein the magnetism adjusting unit rotates the shielding member along an outer periphery of the second core to switch the shielding member between the shielding position and the retracted position.

3. The image forming apparatus according to claim 2, wherein when the ratio of the length of the shielding member in the rotation direction of the shielding member relative to the length of the shielding member attained by one complete rotation thereof is defined as a shielding ratio, the shielding ratio varies in the width direction of the sheet.

4. The image forming apparatus according to claim 3, wherein the shielding ratio decreases in the width direction of the sheet from an end of the second core toward a central portion thereof.

5. The image forming apparatus according to claim 1, wherein:

the heating member has a sheet-conveyed region through which the sheet is conveyed, and is heatable in a width direction of the sheet over the entire sheet-conveyed region by induction heating by the coil;

the second core extends in the width direction of the sheet to form the magnetic path over the entire sheet-conveyed region; and portions of the shielding member are positioned outward of the sheet-conveyed region set to a minimum with respect to the width direction of the sheet.

6. The image forming apparatus according to claim 5, wherein the shielding member has a plurality of ring surfaces arranged along an outer periphery of the second core, the ring surfaces having different lengths in the width direction of the sheet.

7. The image forming apparatus according to claim 1, wherein the ring surface of the shielding member is employed in a plural number along the outer periphery of the second core.

8. The image forming apparatus according to claim 1, wherein:

the coil is arranged to surround the heating member;

the first core is divided into core elements arranged on both sides of a central part of the coil; and the second core is arranged at a position where the magnetic path joins to the central part of the coil after passing the core elements of the first core on both sides thereof.

9. The image forming apparatus according to claim 1, wherein:

the coil is arranged to surround the heating member;

the heating member is made of a nonmagnetic metallic material; and the shielding member is arranged inside the heating member.

10. The image forming apparatus according to claim 1, wherein the shielding member is made of copper.

11. The image forming apparatus according to claim 10, wherein the shielding member has a thickness within the range of 0.5 mm to 3 mm.

* * * * *